US006715856B2

(12) United States Patent
Mihara

(10) Patent No.: US 6,715,856 B2
(45) Date of Patent: Apr. 6, 2004

(54) IMAGE-RECORDING APPARATUS

(75) Inventor: Suguru Mihara, Hachioji (JP)

(73) Assignee: Olympus Optical Co., Ltd., Tokyo (JP)

( * ) Notice: Subject to any disclaimer, the term of this patent is extended or adjusted under 35 U.S.C. 154(b) by 15 days.

(21) Appl. No.: 10/234,803

(22) Filed: Sep. 3, 2002

(65) Prior Publication Data

US 2003/0043249 A1 Mar. 6, 2003

(30) Foreign Application Priority Data

Sep. 3, 2001 (JP) ..... 2001-266246

(51) Int. Cl.[7] ..... B41J 23/00; B41J 2/145; B41J 2/15

(52) U.S. Cl. ..... 347/37; 347/40

(58) Field of Search ..... 347/37, 40, 20, 347/23; 400/292, 315

(56) References Cited

U.S. PATENT DOCUMENTS 6,267,519 B1 * 7/2001 Otsuki et al. ..... 400/283
6,334,720 B1 * 1/2002 Kato et al. ..... 400/74
6,390,588 B1 * 5/2002 Ikeda ..... 347/19

FOREIGN PATENT DOCUMENTS

JP 9-240098 A 9/1997
JP 10-250058 A 9/1998

* cited by examiner

*Primary Examiner*—Thinh Nguyen
(74) *Attorney, Agent, or Firm*—Frishauf, Holtz, Goodman & Chick, P.C.

(57) ABSTRACT

There is disclosed an image-recording apparatus including a recoding head, a carriage which is reciprocatable along a main scanning direction, and carriage-driving mechanism for moving the carriage along the main scanning direction. The carriage-driving mechanism reciprocates the carriage so that a phase of a periodic speed fluctuation of the carriage during a forward movement deviates from the phase of the periodic speed fluctuation during a backward movement.

22 Claims, 15 Drawing Sheets

IMAGE-RECORDING APPARATUS

CROSS-REFERENCE TO RELATED APPLICATIONS

This application is based upon and claims the benefit of priority from the prior Japanese Patent Application No. 2001-266246, filed Sep. 3, 2001, the entire content of which is incorporated herein by reference.

BACKGROUND OF THE INVENTION

1. Field of the Invention

The present invention relates to an image-recording apparatus which ejects ink to a recording-medium and records an image.

2. Description of the Related Art

Image-recording apparatuses such as an ink jet printer, ejects ink to recording media such as paper and a records an image. The image-recording apparatus comprises a recording-head for discharging ink to the recording-medium; a carriage for holding the recording-head; conveying means for conveying the recording-medium; and carriage-driving mechanism for moving the recording-head in a direction (main scanning direction) crossing at right angles to a conveying direction (sub scanning direction) of the recording-medium by the conveying means.

In the image-recording apparatus, the carriage is driven along the main scanning direction. When the carriage is driven, the recording-head is moved along the main scanning direction. During the movement, the recording-head ejects ink drops to the recording-medium. Thereby, the image-recording apparatus puts the ink drops to the recording-medium at substantially constant pitches along the main scanning direction. Thereby, the image-recording apparatus records an image corresponding to a width of the recording-head in the recording-medium. The image-recording apparatus repeats the above-described recording on the recording-medium intermittent conveyed along the sub scanning direction. The image-recording apparatus repeats the recording to record the whole image in the recording-medium.

A conventional image-recording apparatus will be described hereinafter. FIG. 12 is a side view showing the conventional image-recording apparatus. In the image-recording apparatus, as shown in FIG. 12, carriage-driving mechanism 110 includes a pair of pulleys 111, endless belt 112, motor 113, and carriage support portion 114. Moreover, the carriage is denoted with a reference numeral 120 in FIG. 12. The carriage 120 has a recording-head. Additionally, in FIG. 12, the sub scanning direction is a direction extending along an arrow AS. The main scanning direction extends along an arrow AM.

A pair of pulleys 111 are disposed apart from each other along the main scanning direction. An image-recording area ZP and two reverse areas ZR are disposed between the pair of pulleys 111. The image is recorded to a recording-medium 200 in the image-recording area ZP. A width of the image-recording area ZP along the main scanning direction is set to be substantially the same as or slightly larger than the width of the recording-medium 200. In the reverse areas ZR, the movement direction of the carriage 120 moved along the main scanning direction is reversed. The reverse areas ZR will be described in more detail. The carriage 120 moves in the image-recording area ZP. When the carriage 120 moves beyond the image-recording area ZP, the carriage 120 changes its moving-direction (turns about) toward the image-recording area ZP again. That is, the carriage changes its moving-direction in the reverse areas ZR. Therefore, the reverse areas ZR are disposed near the respective pulleys 111. In other words, the reverse areas ZR are disposed on the opposite sides via the image-recording area ZP between the pair of pulleys 111.

The endless belt 112 is supported by the pair of pulleys 111.

The motor 113 is connected to one of the pair of pulleys 111. The motor 113 supplies its driving force to the pulleys 111.

The carriage support portion 114 is fixed to the endless belt 112, and supports the carriage 120. That is, the carriage 120 is fixed to the endless belt 112 via the carriage support portion 114.

The carriage-driving mechanism 110 is driven by the motor 113 to operate the endless belt 112 supported by the pulleys 111. The carriage 120 can be reciprocated along the main scanning direction by the action of the endless belt 112. Therefore, the carriage-driving mechanism 110 can reciprocate the recording-head fixed to the carriage 120 along the main scanning direction.

There is an image-recording apparatus of a reciprocating print type. The reciprocating print type is an image recording system for discharging ink in both forward and backward movements during the reciprocating movement of the recording-head, and recording the image. Moreover, the image-recording apparatus has various types of arrangement of the recording-head. For example, as described in Jpn. Pat. Appln. KOKAI Publication No. 1998-250058, there is also an image-recording apparatus in which a plurality of recording-heads are arranged along the main scanning direction.

In the above-described image-recording apparatus, while the recording-head is moved, the ink is ejected. Therefore, in the image-recording apparatus, in order to record a high-quality image, it is preferable to move the recording-heads constantly at a constant speed in the image-recording area ZP. For this, the carriage-driving mechanism 110 needs to include the pulleys 111 and motor 113 which completely have no eccentricity. That is, the carriage-driving mechanism 110 in an ideal state includes the pulleys 111 and motor 113 which completely have no eccentricity. However, in the actual carriage-driving mechanism 110, it is very difficult to completely remove the eccentricity of the pulleys 111 and motor 113.

Additionally, an action of the image-recording apparatus including the carriage-driving mechanism 110 in the ideal state will be described hereinafter with reference to FIG. 13. FIG. 13 is a diagram showing shot positions that the ink drops ejected in the above-described ideal state take on the recording-medium 200. Additionally, FIG. 13 is a schematic enlarged top plan view showing the operating recording-heads of the image-recording apparatus of FIG. 12. Additionally, in the following description, a case in which the image-recording apparatus records the image in the reciprocating print mode, particularly one path reciprocating print mode.

In FIG. 13, a reference character Vf denotes a set movement speed in the forward movement of the recording-head 130, and reference character Vr denotes the set movement speed in the backward movement of the recording-head 130. Additionally, the set movement speeds Vf, Vr in the forward and backward movements are set to be the same in order to move the carriage 120 at the constant speed. Furthermore, in the image-recording apparatus, the carriage-driving mechanism 110 in the ideal state drives the recording-head 130 via the carriage 120. As a result, the speed of the recording-head 130 in the reciprocating movement is constantly the same as the set movement speeds Vf, Vr.

First, the action of the recording-head 130 which moves in the forward movement will be described.

The recording-head 130 in FIG. 13 is moved by the carriage-driving mechanism 110 along the main scanning direction in the ideal state. Therefore, the recording-head 130 moves at the set movement speed Vf as set along the main scanning direction.

The recording-head 130 is apart from the recording-medium 200 by a distance Dg. Therefore, a time t obtained by the following equation 1 is required from when the ink drops are ejected from the recording-head 130 until the ink drops are shot on the recording-medium 200.

$$t=Dg/Vi \qquad \text{Equation 1}$$

Where Vi is a eject speed of ink

Subsequently, in the forward movement, the ink drops are ejected from the recording-head 130 which is moving at the speed Vf, and therefore deviate from ejecting positions toward a forward direction of the recording-head 130. Therefore, in the forward movement the ink drops ejected from the recording-head 130 have shot positions which deviate from the eject positions by a distance Df obtained by the following equation.

$$Df=Vf\times t \qquad \text{Equation 2}$$

The action of the recording-head 130 during the backward movement will next be described.

The recording-head 130 in FIG. 13 is moved by the carriage-driving mechanism 110 in the ideal state, and therefore moves at the set movement speed Vf as set. Also during the backward movement, the recording-head 130 ejects the ink drops at a eject speed similar to that of the forward movement. Therefore, similarly as the forward movement, a time required until the ink drops are shot on the recording-medium 200 is time t.

Moreover, during the backward movement, the ink drops are ejected from the recording-head 130 moving at the set movement speed Vr. Therefore the ink drops deviate from the eject positions toward the moving-direction of the recording-head 130. Therefore, in the forward movement, the ink drops is struck at the shot positions which deviate from the eject positions by a distance Dr obtained by the following equation 3.

$$Dr=Vr\times t \qquad \text{Equation 3}$$

Additionally, the recording-head 130 has the same speed (set movement speed Vf=Vr) during the forward and backward movements as described above. Therefore, as seen from the above equations 2, 3, the distance Dr is equal to the distance Df.

The ink drops ejected by the recording-head 130 is shot in a desired shot position Pi in the ideal state. The shot position Pi is the same position along the main scanning direction in the forward and backward movements. Therefore, as shown in FIG. 13, the recording-head 130 ejects the ink from the eject position apart from the shot position Pi by the same distance along the main scanning direction in the forward and backward movements. The ink drops **300*f* is ejected in the forward movement and ink drops 300*r* is ejected in the backward movement. When the recording-head 130 ejects the ink drops from the eject positions, the ink drops 300*f* and 300*r* are shot at the same shot position Pi in the main scanning direction. Additionally, the recording-head 130 includes a plurality of ink jet ports along the sub scanning direction. Therefore, the ink drops 300*r* and 300*f*** are shot so that the drops are aligned in one row along the sub scanning direction on the recording-medium. That is, the shot ink drops (ink dots) form a line. The line by the ink dots will hereinafter be referred to as ink-dots-line.

The recording-head 130 ejects the ink drops to the respective desired shot positions Pi at constant pitches in the main scanning direction from the eject positions calculated based on the set movement speeds in the forward and backward movements. Thereby, the recording-head 130 can shoot the ink drops in the respective desired shot positions over the main scanning direction so that the ink drops are aligned in one row along the sub scanning direction. Therefore, the image-recording apparatus can shoot the ink drops in the desired positions at the constant pitches along the main scanning direction without any special control and/or processing.

However, as described above, it is very difficult to process the pulleys 111 and motor 113 without any eccentricity. The carriage-driving mechanism 110 rotates the motor 113 at a constant rotation number in order to move the carriage at the constant speed. In this case, if the pulleys 111 and motor 113 are eccentric, the movement speed of the carriage 120 fluctuates. The carriage-driving mechanism 110 is set so that the carriage 120 is constantly moved at the set movement speeds Vf, Vr. However, because of the above-described eccentricity, the carriage-driving mechanism 110 cannot convey the carriage 120 constantly at the set movement speeds Vf, Vr over the whole image-recording area ZP.

Each pulley 111 has a radius r. In this case, the speed fluctuation of the carriage 120 during the forward and backward movements is as shown in FIG. 14. FIG. 14 is a graph showing the speed fluctuation of the carriage 120, whose abscissa indicates the position of the carriage 120 in the main scanning direction and whose ordinate indicates the speed of the carriage 120.

In FIG. 14, the speed fluctuation of the carriage 120 in the forward movement is shown by a curve Cf, and the speed fluctuation in the backward movement is shown by a curve Cr. Additionally, the set movement speed Vf for the forward movement is equal to the set movement speed Vr for the backward movement. Moreover, the carriage 120 is reciprocated by driving of the pulleys 111 and motor 113. Therefore, a width of the speed fluctuation becomes the same in the forward and backward movements. Therefore, amplitudes of the speed fluctuations (widths of fluctuations of speeds with respect to the set movement speeds Vf, Vr) $\Delta Vf$, $\Delta Vr$ have substantially the same value.

In the forward/backward movement, a period of the speed fluctuation of the carriage 120 is repeated every rotation of the pulleys 111. Moreover, the speed of the carriage 120 repeats increase and decrease with respect to the set movement speeds Vf, Vr in the forward/backward movement every ½ period of the speed fluctuation. For example, as shown in FIG. 14, in the forward movement, the movement speed of the carriage 120 is slow with respect to the set movement speed Vf during the movement from an entire position by $\pi r$. The entire position is a position where the carriage 120 enters the image-recording area ZP (position shown by 0 in FIG. 14). In other words, the movement speed of the carriage 120 is slow with respect to the set movement speed Vf between the positions 0 and $\pi r$ in FIG. 14.

Moreover, the movement speed of the carriage 120 is fast with respect to the set movement speed Vf from when a movement distance of the carriage 120 passes πr until the distance reaches 2πr. In other words, the movement speed of the carriage 120 is fast with respect to the set movement speed Vf between the positions πr and 2πr in FIG. 14.

Moreover, the carriage 120 is fixed to the endless belt 112. Therefore, as shown in FIG. 14, the speed fluctuation of the carriage 120 is in the same phase in the forward and backward movements. In this case, the speed becomes substantially the same in each position along the main scanning direction in the forward/backward movement. Additionally, since the recording-head 130 is attached to the carriage 120, the movement speed of the head has the same speed fluctuation as that of the carriage 120.

Therefore, as shown in FIG. 14, the movement speed of the carriage 120 is slow with respect to the set movement speed Vf between the positions 0 and πr during the backward movement similarly as during the forward movement. The speed Vf is the same as the set movement speed Vr. Therefore the movement speed of the carriage 120 is slow with respect to the speed Vr between the positions 0 and πr during the backward movement. Moreover, the movement speed of the carriage 120 is fast with respect to the set movement speed Vr between the positions πr and 2πr during the backward movement similarly as during the forward movement.

The shot positions of the ink drops ejected from the recording-head 130 which moves in a period of speed fluctuation shown in FIG. 14, will be described hereinafter with reference to FIGS. 15 and 16. FIG. 15 is a diagram showing the shot positions of the ink drops ejected by the recording-head 130 which moves at the speed fluctuation shown in FIG. 14 during the movement in a position (½)πr in FIG. 14. FIG. 16 is a diagram showing the shot positions of the ink drops ejected by the recording-head 130 which moves at the speed fluctuation shown in FIG. 14 during the movement in a position (3/2)πr in FIG. 14.

First, the shot positions of the ink drops ejected by the recording-head 130 in the position (½)πr in FIG. 14 will be described with reference to FIG. 15.

In the position (½)πr in the forward movement, as shown in FIG. 14, the movement speed of the recording-head 130 is a speed (Vf−ΔVf) obtained by subtracting ΔVf from the set movement speed Vf. In this case, a time for shooting the ink drops 300*f* onto the recording-medium 200 is similar to the time t obtained by the equation 1.

Moreover, the ink drops 300*f* are ejected from the recording-head 130 which is moving at the movement speed (Vf−ΔVf). Therefore, the shot positions of the ink drops 300*f* deviate from the shot positions Pi during the movement at the set movement speed Vf by a distance ΔDf obtained by the following equation 4.

$$\Delta Df=(-\Delta Vf)\times t \qquad \text{Equation 4}$$

That is, as shown in FIG. 15, the shot positions of the ink drops 300*f* deviate from the shot positions Pi by ΔDf in a direction opposite to the moving-direction of the head.

As shown in FIG. 14, in the position (½)πr in the backward movement, the recording-head 130 has a movement speed (Vr−ΔVr) obtained by subtracting ΔVr from the set movement speed Vr. The time for shooting the ink drops 300*r* onto the recording-medium 200 is similar to the time t obtained by the equation 1.

Moreover, the ink drops 300*r* are ejected from the recording-head 130 which is moving at the movement speed (Vr−ΔVr). Therefore, the shot positions of the ink drops 300*r* deviate from the shot positions Pi during the movement at the set movement speed Vr by a distance ΔDr obtained by the following equation 5.

$$\Delta Dr=(-\Delta Vr)\times t \qquad \text{Equation 5}$$

That is, as shown in FIG. 15, the shot positions of the ink drops 300*r* deviate from the shot positions Pi by ΔDr in the direction opposite to the moving-direction of the head.

As described above, in the position (½)πr, the ink drops 300*f*, 300*r* are apart from each other by a distance (ΔDf+ΔDr) obtained by adding the distance ΔDf to ΔDr along the main scanning direction.

The shot positions of the ink drops ejected by the recording-head 130 in the position (3/2)πr in FIG. 14 will next be described with reference to FIG. 16.

In the position (3/2)πr in the forward movement, as shown in FIG. 14, the movement speed of the recording-head 130 is a speed (Vf+ΔVf) obtained by adding ΔVf from the set movement speed Vf. In this case, the time for shooting the ink drops 300*f* onto the recording-medium 200 is similar to the time t obtained by the equation 1.

Moreover, during the forward movement, the ink drops 300*f* are ejected from the recording-head 130 which is moving at the movement speed (Vf+ΔVf). Therefore, the shot positions of the ink drops 300*f* deviate from the shot positions Pi during the movement at the set movement speed Vf by a distance ΔDf obtained by the following equation 6.

$$\Delta Df=\Delta Vf\times t \qquad \text{Equation 6}$$

That is, as shown in FIG. 16, the shot positions of the ink drops 300*f* deviate from the shot positions Pi by ΔDf in the moving-direction of the head.

As shown in FIG. 14, in the position (3/2)πr in the backward movement, the recording-head 130 has a movement speed (Vr+ΔVr) obtained by adding ΔVr to the set movement speed Vr. The time for shooting the ink drops 300*r* onto the recording-medium 200 is similar to the time t obtained by the equation 1.

Moreover, during the backward movement the ink drops 300*r* are ejected from the recording-head 130 which is moving at the movement speed (Vr+ΔVr). Therefore, the shot positions of the ink drops 300*r* deviate from the shot positions Pi during the movement at the set movement speed Vr by a distance ΔDr obtained by the following equation 7.

$$\Delta Dr=\Delta Vr\times t \qquad \text{Equation 7}$$

That is, as shown in FIG. 16, the shot positions of the ink drops 300*r* deviate from the shot positions Pi by ΔDr in the moving-direction of the head.

As described above, also in the position (3/2)πr, the ink drops 300*f*, 300*r* are apart from each other by the distance (ΔDf+ΔDr) obtained by adding the distance ΔDf to ΔDr along the main scanning direction.

When the shot positions of the ink drops 300*f*, 300*r* are apart from each other in this manner, the formed ink-dot-line spreads along the main scanning direction as compared with the ink-dot line shown in FIG. 13. That is, the width of the ink-dot-line becomes thick as compared with the ink-dot-line shown in FIG. 13.

However, in the image-recording apparatus, when the recording-head 130 ejects the ink in the position πr, similarly as the recording-head moved by the carriage-driving mechanism in the ideal state in FIG. 13, the ink drops 300*f*, 300*r* are shot in the same position along the main scanning direction. In this case, the width of the formed ink-dot-line is substantially the same as that of the ink-dot-line shown in FIG. 13.

Therefore, when the pulleys 111 and motor 113 are eccentric, for the ink-dot-lines formed in a plurality of shot positions along the main scanning direction, two types of lines narrow and wide in the main scanning direction exist in a mixed manner.

In a monochromatic image is recognized, when a ratio of dots constituting the images in one area not less than a certain size, and the other area adjacent to the one area and not less than the certain size is not less than a predetermined size, an ordinary person recognizes the presence of a gradation difference, that is, density difference in the image. This is considered in the ink dots of the image recorded in the image-recording apparatus. The ink drops 300*r*, 300*f* are shot in the predetermined positions Pi and in positions deviating from the predetermined positions Pi in a mixed manner. Therefore, in the image, the ink-dot-lines narrow and wide in the main scanning direction exist in the mixed manner. Moreover, the thin and thick ink-dot-lines are alternately and repeatedly recorded in the main scanning direction in a predetermined period. In comparison of the thin and thick ink-dot-lines with each other, there is a possibility that any person visually recognizes the presence of the density difference between the lines. In other words, the image has a difference in a spread along the main scanning direction between the adjacent ink-dot-lines. Therefore, there is a possibility that the ordinary person recognizes the presence of the density difference in the image. Therefore, there is a possibility that the image recorded by the image-recording apparatus is recognized to have a density unevenness.

In the image-recording apparatus disclosed in the Jpn. Pat. Appln. KOKAI Publication No. 1998-250058, when the pulley and motor have the eccentricity, the image-recording apparatus is will be described hereinafter.

In the image-recording apparatus described in the Jpn. Pat. Appln. KOKAI Publication No. 1998-250058, as shown in FIG. 17, a plurality of recording-heads 130 are arranged along the main scanning direction. Moreover, the recording-heads 130 are disposed apart from the adjacent recording-head 130 by a predetermined distance respectively. The predetermined distance is corresponding the movement of one period of the speed fluctuation. Therefore, these plurality of recording-heads are intend to be not influenced by the speed fluctuation by the eccentricity. In other words, each recording-head 130 is disposed apart from the adjacent recording-head 130 by the distance corresponding to the movement distance of the recording-head 130 during one rotation of the pulleys 111. Moreover, the image-recording apparatus doesn't perform the reciprocating print mode, but a printing in a one-direction print mode.

Therefore, for each recording-head 130, the movement speed of the recording-heads 130 having ejected the ink in a position in the moving-direction of the recording-head 130 can constantly be the same as the movement speed of the adjacent recording-head 130 continuously discharging the ink in the position, respectively.

However, the image-recording apparatus described in the Jpn. Pat. Appln. KOKAI Publication No. 1998-250058, the recording-heads disposed adjacent to each other are disposed apart from each other by a distance of movement of the recording-head 130 during one rotation of the pulleys 111. Therefore, it is difficult to miniaturize the image-recording apparatus. Moreover, any solving means against the density unevenness generated in the reciprocating movement is not disclosed in the image-recording apparatus.

In consideration of the above-described problems, there has been a demand for an image-recording apparatus which reduces or prevents generation of density unevenness (color unevenness) in the recorded image and which can record a high-precision image even with the speed fluctuation of the recording-head because of the eccentricity of the pulley or the motor.

Moreover, there has been a demand for an image-recording apparatus which includes a plurality of recording-heads, which can record the high-precision image even with the speed fluctuation of the recording-head and whose main body can be miniaturized.

BRIEF SUMMARY OF THE INVENTION

According to one aspect of the present invention, an image-recording apparatus conveying a recording-medium and recording an image on the recording-medium, the apparatus including a main scanning direction which crosses to the conveying direction of the recording-medium, the image-recording apparatus comprises

- a recording-head discharging ink to the recording-medium;
- a carriage on which the recording-head is mounted and the carriage which is reciprocatable along the main scanning direction; and
- a carriage drive mechanism reciprocating the carriage along the main scanning direction, wherein the carriage drive mechanism includes:

- a pair of pulleys, a motor supplying a driving force to at least one of the pair of pulleys; and an endless belt which is extended between the pair of pulleys and on which the carriage is mounted, and the carriage drive mechanism reciprocates the carriage so that a phase of a periodic speed fluctuation of the carriage during a forward movement of the carriage deviates from a phase of a periodic speed fluctuation of the carriage during a backward movement of the carriage.

According to another aspect of the present invention, an image-recording apparatus conveying a recording-medium and recording an image on the recording-medium, and the apparatus including a main scanning direction which crosses to the conveying direction of the recording-medium, the image-recording apparatus comprises:

- the recording-head which ejects ink to the recording-medium;
- a carriage on which the recording-head is mounted and the carriage which is reciprocatable along the main scanning direction; and
- a carriage drive mechanism which reciprocates the carriage along the main scanning direction, wherein the carriage drive mechanism includes:

- a pair of pulleys; a motor which supplies a driving force to at least one of the pair of pulleys; and an endless belt which is extended between the pair of pulleys and on which the carriage is mounted, and the carriage drive mechanism reciprocates the carriage and impart a phase difference of (1/X)2p radian in periodic speed fluctuation between any reciprocation and the immediately following reciprocation, where X is a number of path through which the carriage is reciprocated in a multi-pass printing mode.

According to further aspect of the present invention, an image-recording apparatus conveying a recording-medium and recording an image on the recording-medium, comprises:

- a plurality of recording-heads which are arranged along a conveying direction of the recording-medium, each of the a recording-head discharging ink to the recording-medium;

a carriage on which the plurality of recording-heads are mounted and which can reciprocate along a main scanning direction crossing to a conveying direction of the recording-medium; and a carriage drive mechanism which moves the carriage along the main scanning direction, wherein the plurality of recording-heads are arranged so that an interval from the adjacent recording-head in the main scanning direction is a distance other than a distance integer times a distance in which carriage moves during one period of a speed fluctuation of the carriage.

According to still another aspect of the present invention, an image-recording apparatus conveying a recording-medium and recording an image on the recording-medium, the apparatus including a main scanning direction which crosses to the conveying direction of the recording-medium, the image-recording apparatus comprises:

two recording-heads which eject the same color of ink;

a carriage which holds the two recording-heads arranged along the main scanning direction and which is reciprocatable along the main scanning direction; and a carriage drive mechanism which moves the carriage along the main scanning direction, wherein the two recording-heads are arranged on the carriage so that an arrangement interval between the recording-heads is a distance odd-number times a distance in the carriage moves during ½ period of periodic speed fluctuation of the carriage, one of the two recording-heads is used to record the image, when the carriage is moved forwards, and the other recording-head is used to record the image, when the carriage is moved backwards.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will be described hereinafter with respect to the drawings.

(First Embodiment)

Figure 1:
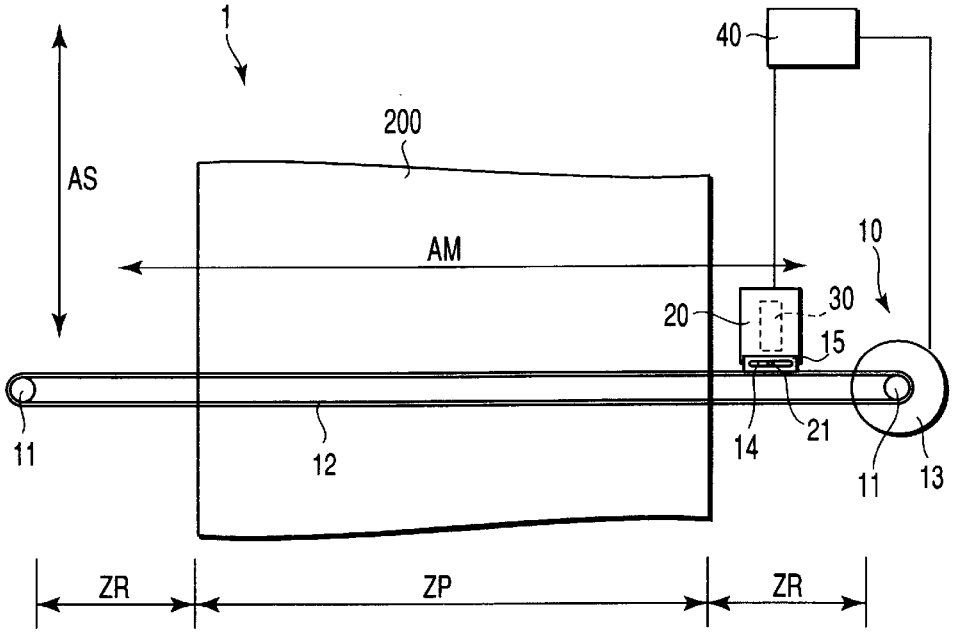
FIG. 1 is a schematic side view showing an image-recording apparatus according to a first embodiment.

First, a first embodiment will be described with reference to FIG. 1. FIG. 1 is a schematic side view showing an image-recording apparatus according to the first embodiment.

An image-recording apparatus 1 of the first embodiment ejects ink to a recording-medium 200 and records an image. The image-recording apparatus 1 includes a recording-head 30, carriage 20, conveying means (not shown), carriage-driving mechanism 10, and control section 40. The recording-head 30 ejects the ink onto the recording-medium 200. The carriage 20 holds the recording-head 30. The conveying means conveys the recording-medium 200. The carriage-driving mechanism 10 moves the recording-head 30 in a direction (main scanning direction) crossing at right angles to a conveying direction (sub scanning direction) of the recording-medium 200 by the conveying means. The control section 40 controls the driving of the recording-head 30 and carriage-driving mechanism 10. Additionally, in FIG. 1, the sub scanning direction is a direction extending along an arrow AS. The main scanning direction extends along an arrow AM.

The recording-head 30 includes a plurality of jet ports, arranged in a row, for discharging ink drops. The recording-head 30 is disposed on the carriage 20 so that the jet ports are arranged along the sub scanning direction and are disposed opposite to the recording-medium 200.

Figure 2:
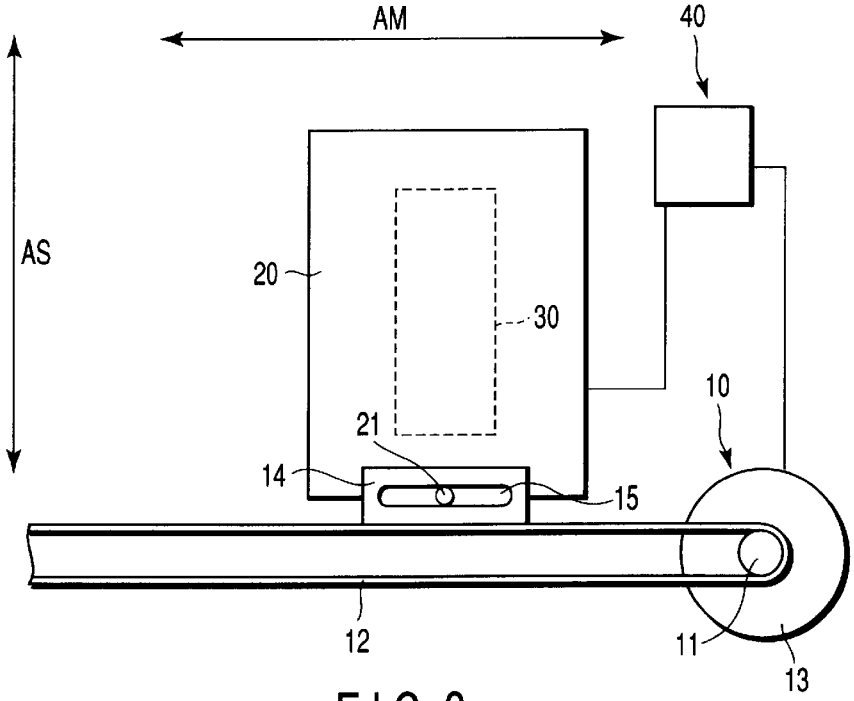
FIG. 2 is an enlarged side view showing a carriage support portion in FIG. 1.

As shown in FIG. 2 described later, the carriage 20 includes a carriage connection portion 21 connected to the carriage-driving mechanism 10 in a bottom thereof. The carriage connection portion 21 has a cylindrical shape. Moreover, the carriage connection portion 21 extends toward opposite sides of a direction crossing at right angles to the main and sub scanning directions.

The carriage-driving mechanism 10 includes a pair of pulleys 11, endless belt 12, motor 13, and carriage support portion 14.

Each pulley 11 has a size of radius r. Moreover, the pulleys 11 are disposed apart from each other along the main scanning direction. An image-recording area ZP and two reverse areas ZR are disposed between the pair of pulleys 11. In the image-recording area ZP, the image is recorded in the recording-medium 200. A width along the main scanning direction of the image-recording area ZP is set to be substantially the same as or slightly larger than the width along the main scanning direction of the recording-medium 200. Therefore, the recording-head 30 ejects the ink so as to record the image in the image-recording area ZP. Therefore, in the present specification, the image-recording area ZP also refers to an area in which the recording-head 30 moves so as to record the image.

In the reverse areas ZR, the movement direction of the carriage 20 moved along the main scanning direction is reversed. The reverse areas ZR will be described in more detail. The carriage 20 moves in the image-recording area ZP. When the carriage 20 moves beyond the image-recording area ZP, the carriage 20 changes its direction (turns about) toward the image-recording area ZP again. The carriage changes its direction in the reverse areas ZR. Therefore, the reverse areas ZR are disposed near side of the respective pulleys 11. In other words, the reverse areas ZR are disposed on the opposite sides (left and right sides in FIG. 1) via the image-recording area ZP between the pair of pulleys 11.

The endless belt 12 is a ring shape, and supported by the pair of pulleys 11. Therefore, the annular endless belt 12 rotates following the rotation of the pulleys 11.

The motor 13 is connected to one of the pair of pulleys 11, and supplies its driving force to the pulleys 11.

The carriage support portion 14 is fixed to the endless belt 12. Moreover, the carriage support portion 14 slidably supports the carriage 20. This respect will be described in more detail with reference to FIG. 2. FIG. 2 is an enlarged side view showing the carriage support portion 14.

The carriage support portion 14 includes a support hole 15 for supporting the carriage connection portion 21. The support hole 15 extends along the main scanning direction, and the carriage connection portion 21 can be inserted in the hole. Moreover, the support hole 15 has substantially the same size as a diameter of the carriage connection portion 21 along the sub scanning direction. Furthermore, the support hole 15 has a size along the main scanning direction such that the carriage connection portion 21 can move by $\pi r$ (r indicates the size of the radius of the pulley 11) along the main scanning direction.

Additionally, in the carriage-driving mechanism 10, the pulleys 11 and motor 13 are processed without any eccentricity so that they efficiently rotate. However, it is difficult to process the pulleys 11 and motor 13 completely without any eccentricity. Therefore, it is assumed that rotation axes of the pulleys 11 and motor 13 are eccentric.

The control section 40 is connected to the carriage-driving mechanism 10 and recording-head 30, and controls the driving of the carriage-driving mechanism 10 and recording-head 30.

A movement of the image-recording apparatus 1 will be described hereinafter. Additionally, for the description of the action, an example in which the image-recording apparatus 1 records the image on a one path reciprocating print mode will be described.

The image-recording apparatus 1 first conveys the recording-medium 200 along the sub scanning direction. When the recording-medium 200 is conveyed to a position disposed opposite to the recording-head 30, the conveying action is once stopped.

When the conveying action is once stopped, the control section 40 issues a driving command to the motor 13. Upon receiving the command, the motor 13 starts driving/rotating the pulleys 11. By the rotation of the pulleys 11, the endless belt 12 rotates, and moves the carriage support portion 14 along the main scanning direction. The carriage support portion 14 is positioned in the reverse area ZR (right area in FIG. 1) before starting the movement. Moreover, the carriage support portion 14 starts moving (to the left side in FIG. 1) toward the image-recording area ZP by the rotation of the endless belt 12. That is, the carriage support portion 14 starts forward movement in the reciprocating movement.

When the carriage support portion 14 starts the forward movement, the support hole 15 also moves along the main scanning direction. Therefore, the carriage connection portion 21 contacts the end (right end in FIG. 1) opposite to the moving-direction of the support hole 15. Moreover, the carriage 20 is moved with the forward movement of the carriage support portion 14. Furthermore, since the recording-head 30 is held to the carriage 20, the head is moved with the forward movement of the carriage 20.

Additionally, in the forward movement, the control section 40 sets a rotation number of the motor 13 to a constant rotation number in order to move the recording-head 30 in the image-recording area ZP at an constant speed.

When the recording-head 30 enters the image-recording area ZP by the forward movement, the control section 40 issues an ink jet command to the recording-head 30. In response to the command, the recording-head 30 ejects ink drops to the recording-medium 200. In more detail, in response to the command, the recording-head 30 ejects the ink drops at a predetermined timing with the movement along the main scanning direction. The ejecting at a predetermined timing is intended to shoot the ink drops onto the recording-medium 200 at a predetermined interval along the main scanning direction. A plurality of ink drops are ejected as described above via a plurality of jet ports arranged in the row of the recording-head 30. Therefore, the plurality of ink drops are recorded in the row along the sub scanning direction in each shot position along the main scanning direction. In other words, in each shot position, ink dots as the ink drops shot onto the recording-medium 200 form an ink-dot-line along the sub scanning direction. In the forward movement, along the main scanning direction, the recording-head 30 records the image for a recording width along its sub scanning direction.

Subsequently, the recording-head 30 is further moved, goes out of the image-recording area ZP, and enters the reverse area ZR (left area in FIG. 1) opposite to that of a movement start time. When the recording-head 30 enters the reverse area ZR, the control section 40 issues an ink stop command to the recording-head 30, and stops the discharging of the ink by the recording-head 30. Furthermore, the control section 40 issues a command to the carriage-driving mechanism 10 so as to reverse the movement direction of the carriage 20. In response to the command, the motor 13 rotates in reverse, and allows the carriage support portion 14 to start backward movement in a direction (to the right side in FIG. 1) opposite to the moving-direction of the forward movement.

When the carriage support portion 14 starts the backward movement, the support hole 15 also moves backwards along the main scanning direction. Therefore, the carriage connection portion 21 contacts the end (left end in FIG. 1) opposite to the moving-direction of the support hole 15. Thereby, the carriage 20 is moved with the backward movement of the carriage support portion 14. That is, the carriage connection portion 21 contacts the end opposite to the end of the support hole 15 in contact in a forward movement. Therefore, the position of the carriage 20 on the endless belt 12 is moved by a distance of $\pi r$ along the main scanning direction during the forward movement. Additionally, in the forward movement, a position of the carriage 20 while the carriage support portion 14 contacts one end of the support hole 15, is referred to as a first carriage position. And a position of the carriage 20 while the carriage support portion 14 contacts the other end of the support hole 15 in the backward movement, is referred to as a second carriage position. In this case, when the carriage 20 moves to the second carriage position from the first carriage position, the carriage is moved by a distance of $\pi r$. Moreover, since the recording-head 30 is fixed to the carriage 20, the head is moved with the backward movement of the carriage 20 even in the backward movement.

With the image-recording apparatus 1 of the one path reciprocating print recording mode, when the recording-head 30 is in the reverse area ZR, the conveying means conveys the recording-medium 200 along the sub scanning direction by an image recording width of the recording-head 30 along the sub scanning direction. By this conveying, the next recording area along the sub scanning direction of the recording-medium 200 is disposed opposite to the recording-head 30.

During the backward movement of the recording-head 30 in the reverse areas ZR, the control section 40 sets the rotation number of the motor 13 to the constant rotation number in order to move the recording-head at the constant speed.

When the recording-head 30 enters the image-recording area ZP by the backward movement, the control section 40 issues the ink jet command to the recording-head 30 similarly as in the forward movement, and allows the recording-head 30 to eject the ink drops at the predetermined timing.

Subsequently, the recording-head 30 continues its backward movement, goes out of the image-recording area ZP again, and enters the reverse area ZR where the head has been positioned in the start time. When the recording-head 30 enters the reverse area ZR, similarly as in the forward movement, in response to the command of the control section 40, the recording-head 30 stops the discharging of the ink. Furthermore, the conveying means conveys the recording-medium 200 as described above. Additionally, the motor 13 rotates in reverse, so that the carriage support portion 14 starts its forward movement.

The image-recording apparatus 1 repeats the action, and records the image over the sub scanning direction of the recording-medium 200.

As described above, the image-recording apparatus 1 ejects the ink drops onto the recording-head 30 at the predetermined timing with the movement of the recording-head 30. Therefore, the ink-dot-line is recorded at a substantially constant interval along the main scanning direction. However, as shown in the above-described constitution, there is eccentricity in the pulleys 11 and motor 13. Therefore, while the recording-head 30 moves in the image-recording area ZP, the rotation number of the motor 13 is held to be constant, but the carriage-driving mechanism 10 cannot move the carriage 20 along the main scanning direction at the constant speed. For more detail, the movement speed of the carriage 20 changes periodically. That is, the speed fluctuation of the carriage 20 is periodic. The speed fluctuation of the carriage 20 in the first embodiment will be described hereinafter with reference to FIG. 3.

Figure 3:
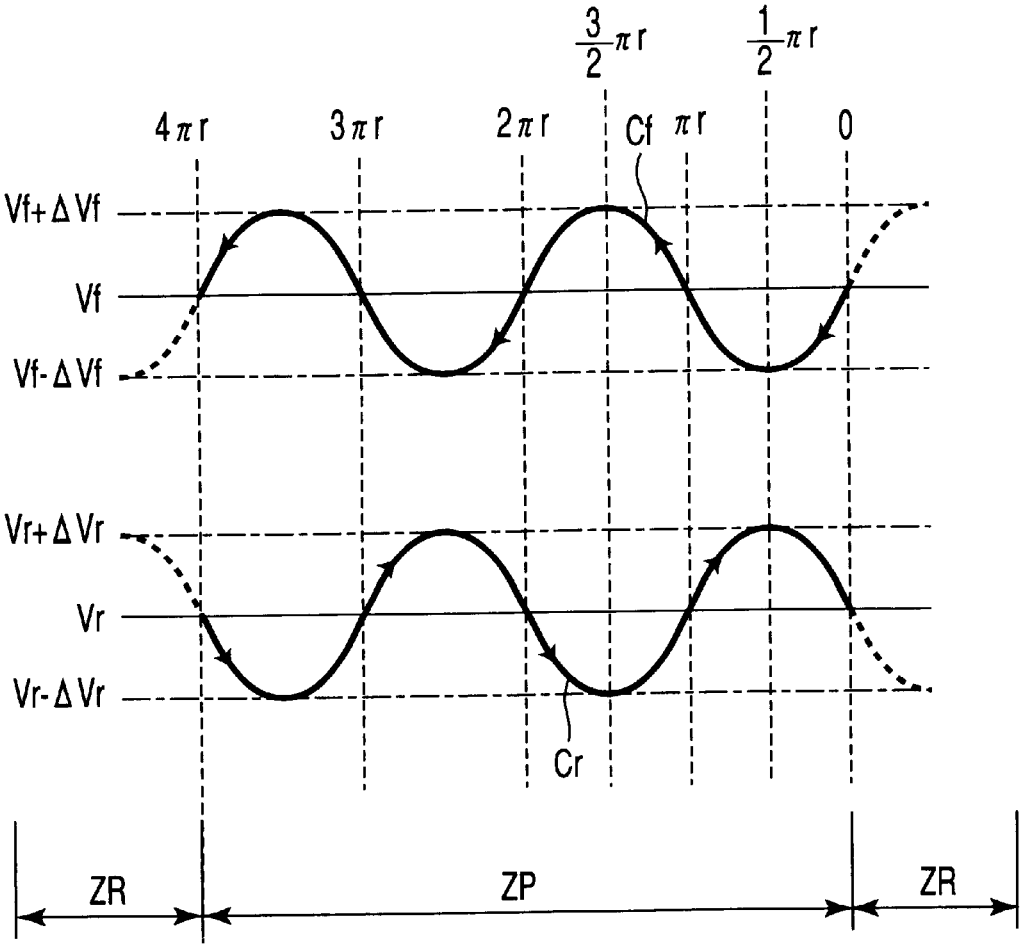
FIG. 3 is a graph showing a speed fluctuation of a carriage in the first embodiment, whose abscissa indicates a position of the carriage in a main scanning direction and whose ordinate indicates a speed of the carriage.

FIG. 3 is a graph showing the speed fluctuation of the carriage 20 in the first embodiment, whose abscissa indicates the position of the carriage 20 in the main scanning direction and whose ordinate indicates the speed of the carriage 20.

Figure 14:
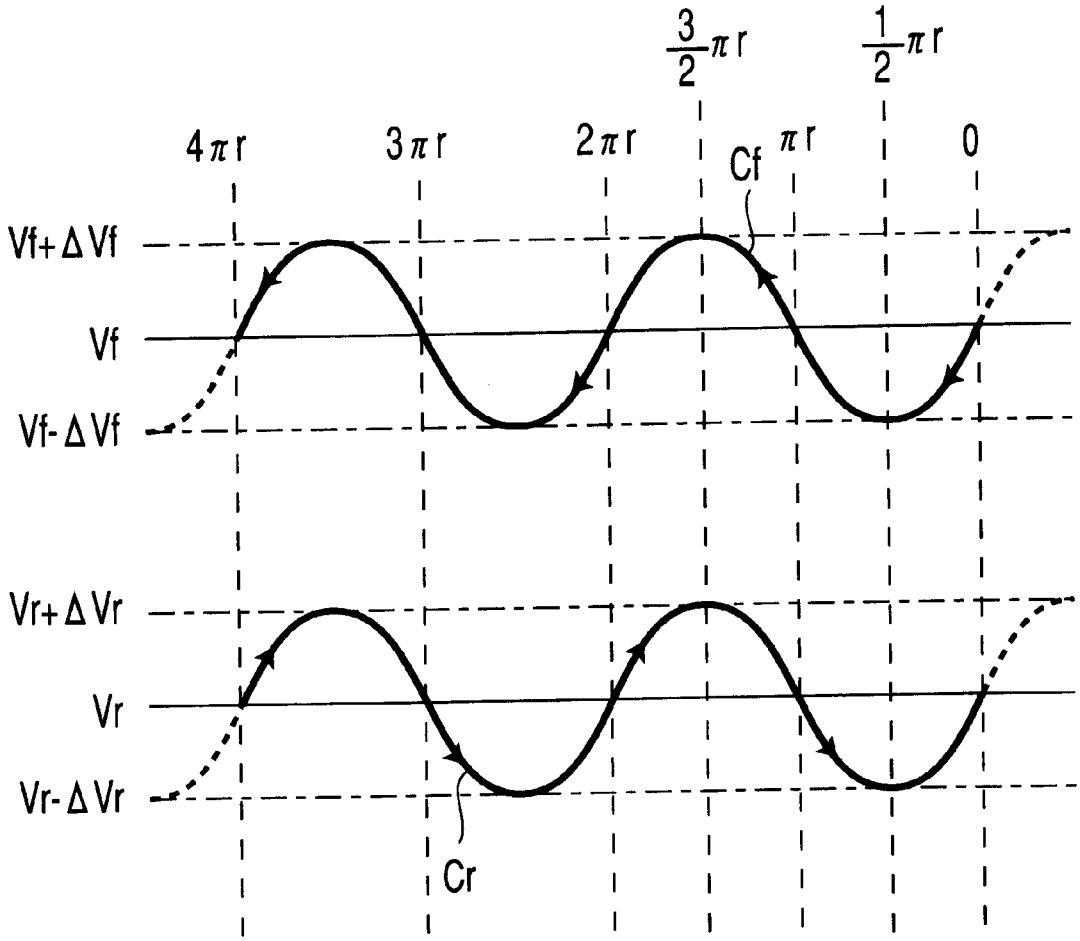
FIG. 14 PRIOR ART
FIG. 14 is a graph showing the speed fluctuation of a carriage, whose abscissa indicates the position of the carriage in the main scanning direction and whose ordinate indicates the speed of the carriage.
Figure 15:
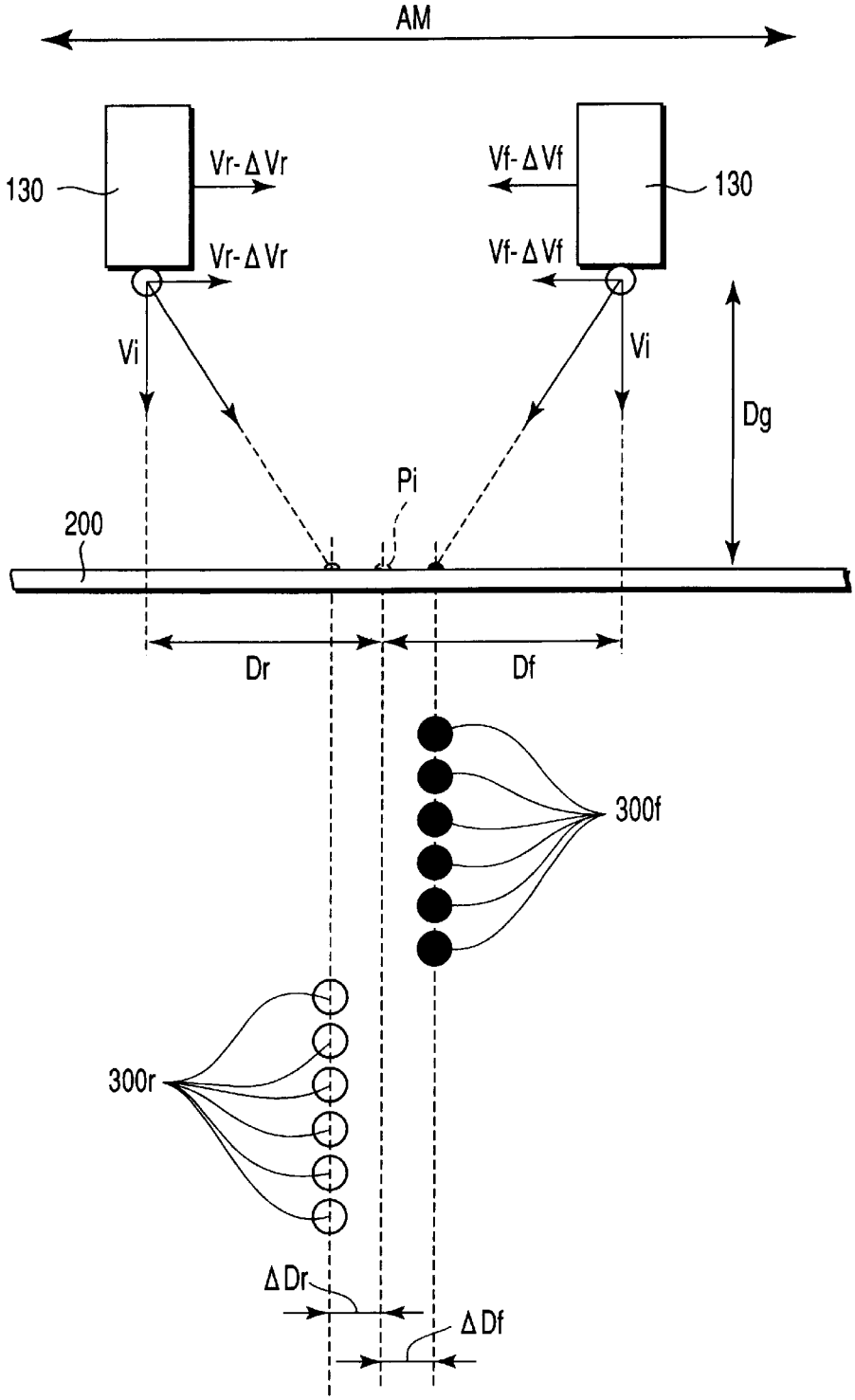
FIG. 15 PRIOR ART
FIG. 15 is a diagram showing the shot positions of ink drops ejected from the recording-head which moves with the speed fluctuation shown in FIG. 14 in a position (½)πr.
Figure 16:
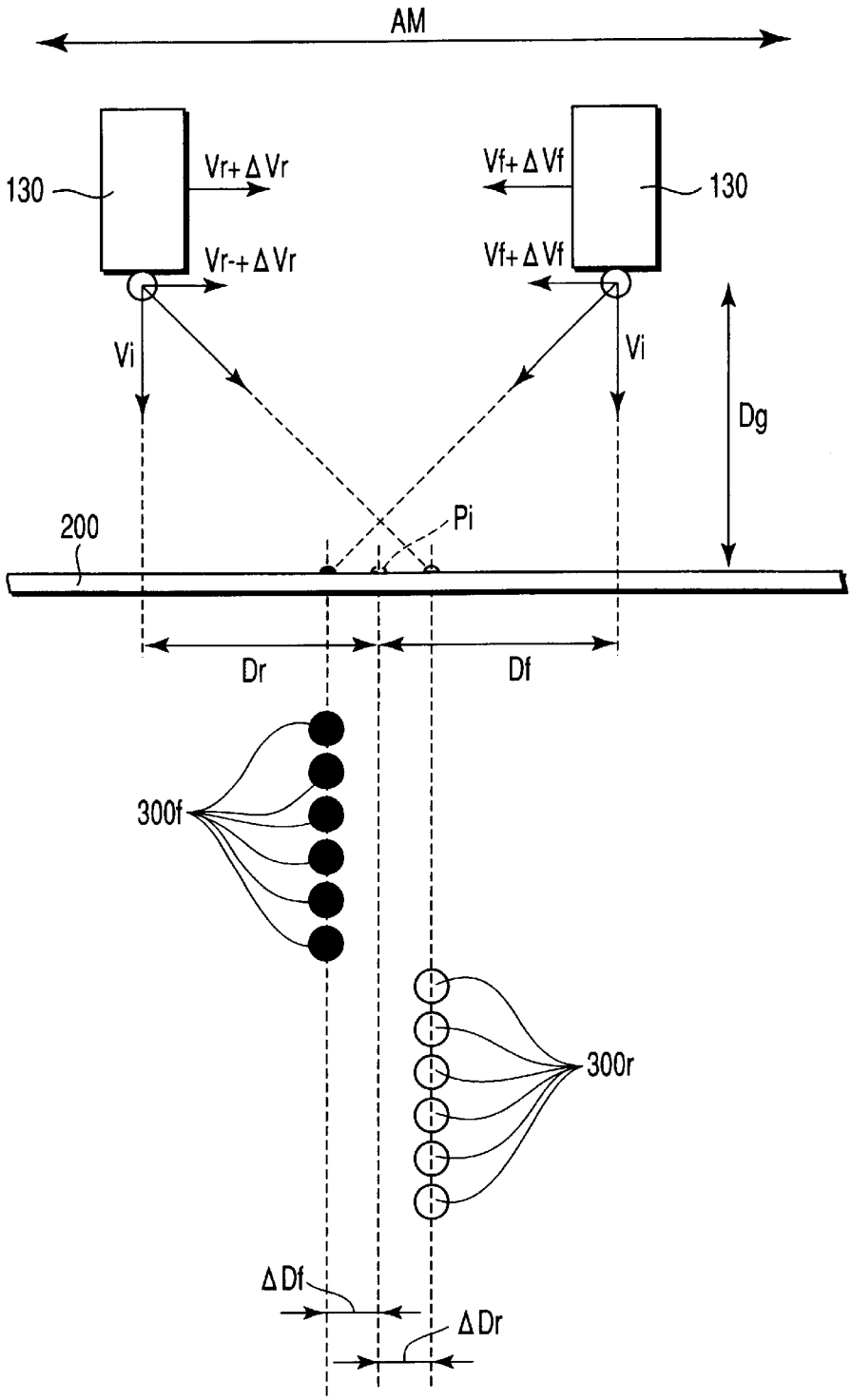
FIG. 16 PRIOR ART
FIG. 16 is a diagram showing the shot positions of ink drops ejected from the recording-head which moves in a period of the speed fluctuation shown in FIG. 14 in a position (3/2)πr.
Figure 17:
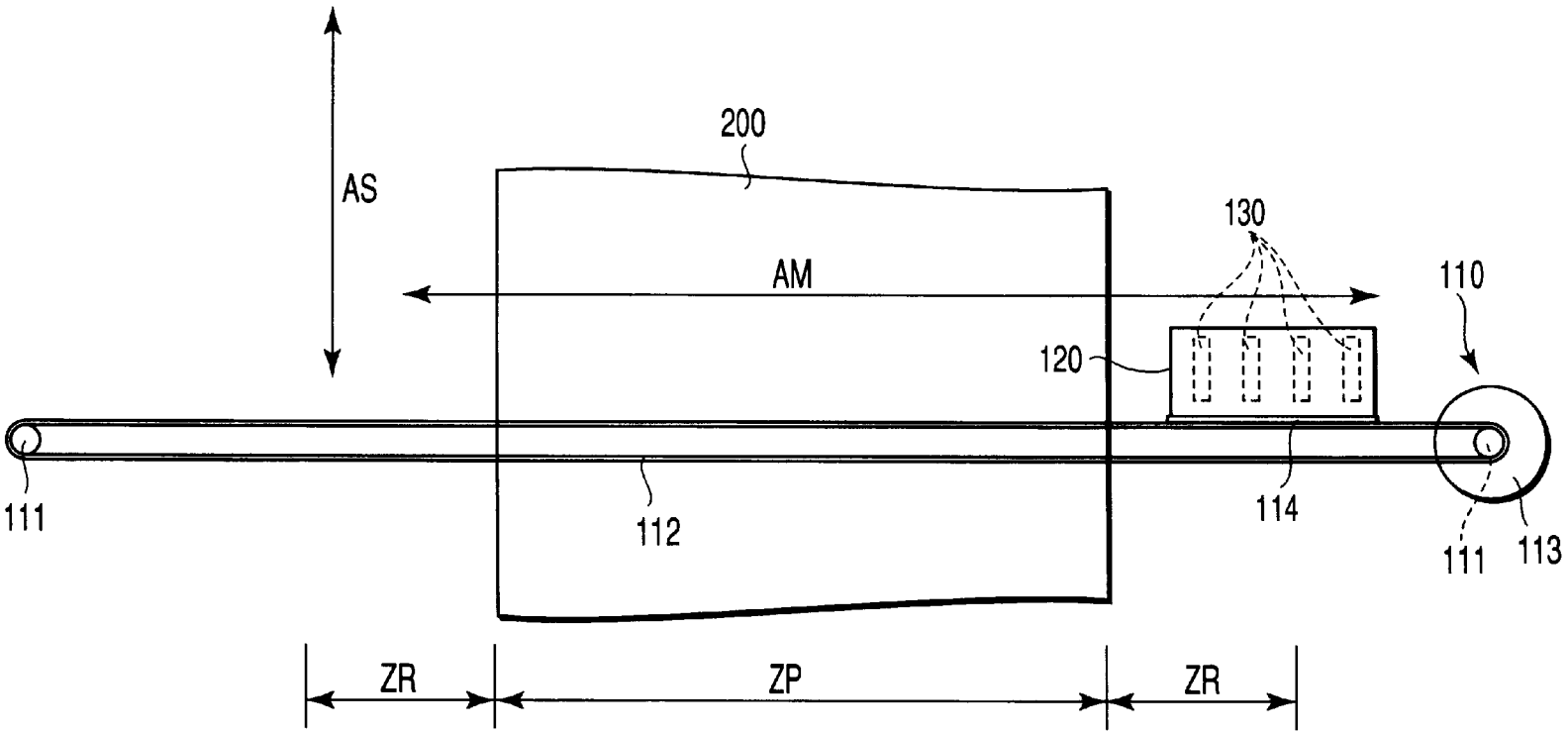
FIG. 17 PRIOR ART
FIG. 17 is a side view showing another conventional image-recording apparatus.

In FIG. 3, the speed fluctuation of the carriage 20 in the forward movement is shown by a curve Cf, and the speed fluctuation in the backward movement is shown by a curve Cr. Additionally, FIG. 3 is similar to FIG. 14 described in the related art except that the curves Cf and Cr have different phases. Therefore, detailed description of FIG. 3 is omitted.

In the first embodiment, during the backward movement, the position of the carriage 20 on the endless belt deviates from the position in the forward movement by a distance $\pi r$ along the main scanning direction in the reverse area ZR. By the deviation of $\pi r$, the speed fluctuation in the backward movement deviates from the speed fluctuation in the forward movement by a ½ period. A position where the carriage 20 enters the image-recording area ZP in the backward movement and moves therefrom by $(5/2)\pi r$, as shown in FIG. 3, is position $(3/2)\pi r$ in FIG. 3. In the position $(3/2)\pi r$, the movement speed of the carriage 20 in the backward movement is slower than a set movement speed Vr by $\Delta Vr$. Additionally, in this position, the movement speed of the carriage 20 in the forward movement is higher than the set movement speed Vf by $\Delta Vf$. Moreover, a position where the carriage 20 enters the image-recording area ZP in the backward movement and moves therefrom by $(7/2)\pi r$, is position $(½)\pi r$ in FIG. 3. In the position $(½)\pi r$, the movement speed of the carriage 20 in the backward movement is higher than the set movement speed Vr by $\Delta Vr$. Additionally, in this position, the movement speed of the carriage 20 in the forward movement is lower than the set movement speed Vf by $\Delta Vf$. In this manner, in the image-recording apparatus 1 of the first embodiment, phase of the speed fluctuation in forward movement is a reverse phase to one of the backward movements. Additionally, as described above, a value of the speed Vf is the same as that of Vr, and a value of the speed $\Delta Vf$ is also the same as that of $\Delta Vr$. Furthermore, the phase of the speed fluctuation in the forward movement deviates by $\pi$ radian from one of the backward movements. Therefore, the carriage 20 is driven so that a sum of the speeds in the forward and backward movements is a sum of reference speeds Vf and Vr in the image-recording area ZP.

Figure 4:
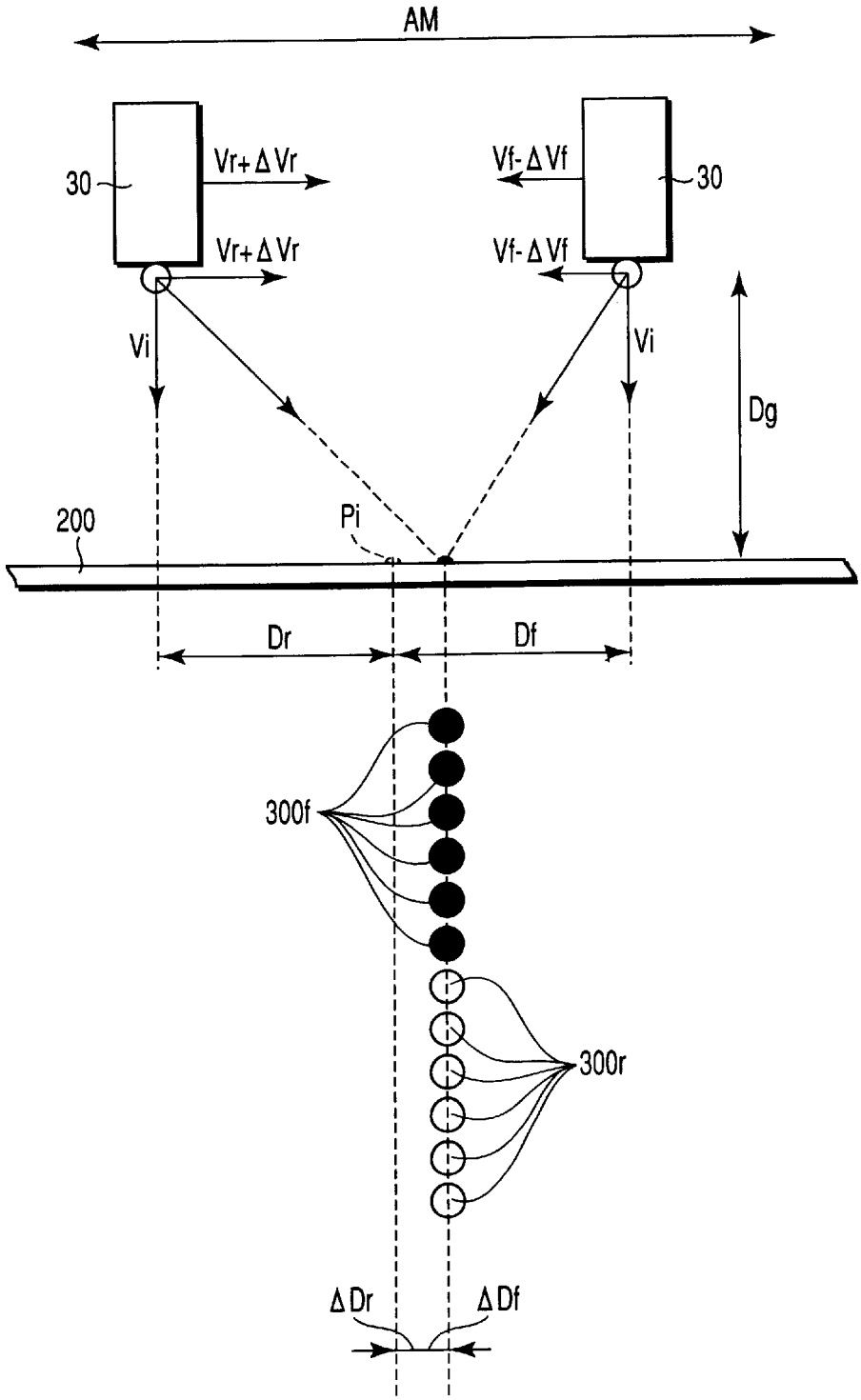
FIG. 4 is a diagram showing shot positions of ink drops ejected by a recording-head moving with the speed fluctuation shown in FIG. 3 in a position (½)πr.
Figure 5:
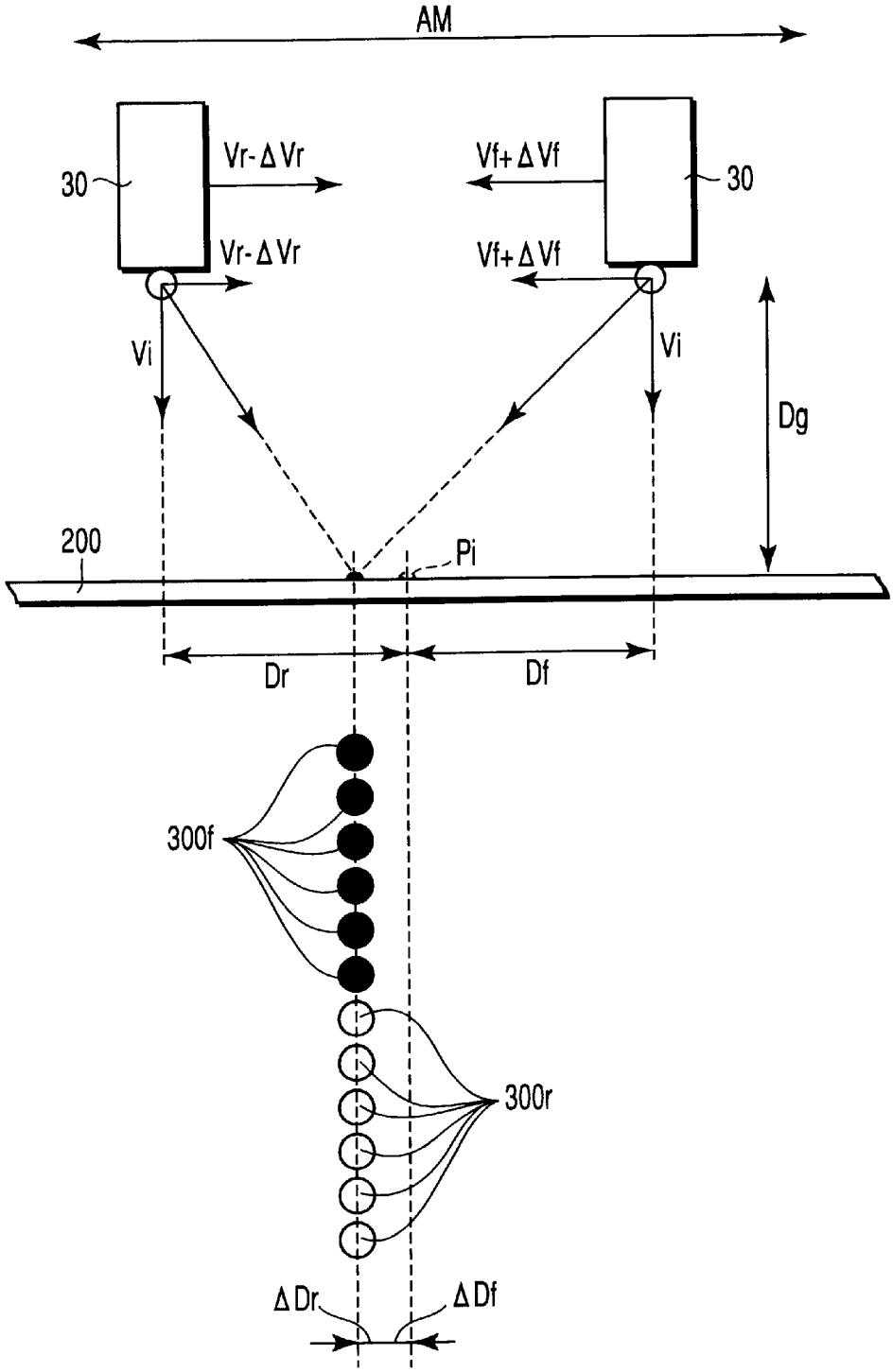
FIG. 5 is a diagram showing the shot positions of the ink drops ejected by the recording-head moving with the speed fluctuation shown in FIG. 3 in a position (3/2)πr.

The shot positions of the ink drops ejected by the recording-head 30 moved with the speed fluctuation will be described hereinafter with reference to FIGS. 4 and 5. FIG. 4 is a diagram showing the shot positions of ink drops ejected by the recording-head 30 moving with the speed fluctuation shown in FIG. 3 in the position $(½)\pi r$. FIG. 5 is a diagram showing the shot positions of the ink drops ejected by the recording-head 30 moving with the speed fluctuation shown in FIG. 3 in the position $(3/2)\pi r$. Additionally, it is assumed that the recording-head 30 is apart from the recording-medium 200 by a distance Dg.

First, the shot positions of the ink drops ejected by the recording-head 30 in the position (½)πr will be described.

In the position (½)πr in the forward movement, as shown in FIG. 3, the movement speed of the recording-head 30 is a speed (Vf−ΔVf) obtained by subtracting ΔVf from the set movement speed Vf. In this case, a time for shooting ink drops 300*f* ejected from the recording-head 30 onto the recording-medium 200 is similar to the time t obtained by the equation 1 described in the related art.

Moreover, the ink drops 300*f* are ejected from the recording-head 30 which is moving at the movement speed (Vf−ΔVf). Therefore, the shot positions of the ink drops 300*f* deviate from the shot positions Pi in the movement at the set movement speed Vf by a distance ΔDf obtained by the equation 4 (ΔDf=(−ΔVf)xt) described in the related art.

That is, as shown in FIG. 4, the shot positions of the ink drops 300*f* deviate from the shot positions Pi by ΔDf in a direction opposite to the moving-direction of the head.

As shown in FIG. 3, in the position (½)πr in the backward movement, the recording-head 30 has a movement speed (Vr+ΔVr) obtained by adding ΔVr to the set movement speed Vr. In this case, the time for shooting ink drops 300*r* ejected from the recording-head 30 onto the recording-medium 200 is similar to the time t obtained by the equation 1.

Moreover, the ink drops 300*r* are ejected from the recording-head 30 which is moving at the movement speed (Vr+ΔVr). Therefore, the shot positions of the ink drops 300*r* deviate from the shot positions Pi in the movement at the set movement speed Vr by a distance ΔDr obtained by the following equation 5'.

$$\Delta Dr=\Delta Vr\times t \qquad \text{Equation 5'}$$

That is, as shown in FIG. 4, the shot positions of the ink drops 300*r* from the recording-head 30 deviate from the shot positions Pi by ΔDr in the moving-direction of the head.

As described above, in the position (½)πr, the ink drops 300*f*, 300*r* ejected from the recording-head 30 are shot in substantially the same position in the main scanning direction. Therefore, the ink-dot-lines by the shot ink drops 300*f*, 300*r* are formed in a substantially linear shape along the sub scanning direction. In other words, the ink-dot-line is formed with a narrow width in the main scanning direction.

The shot positions of the ink drops ejected by the recording-head 30 in the position (3/2)πr will next be described.

In the position (3/2)πr in the forward movement, as shown in FIG. 3, the movement speed of the recording-head 30 is a speed (Vf+ΔVf) obtained by adding ΔVf from the set movement speed Vf. In this case, the time for shooting the ink drops 300*f* ejected from the recording-head 30 onto the recording-medium 200 is similar to the time t obtained by the equation 1.

Moreover, in the forward movement, the ink drops 300*f* are ejected from the recording-head 30 which is moving at the movement speed (Vf+ΔVf). Therefore, the shot positions of the ink drops 300*f* deviate from the shot positions Pi in the movement at the set movement speed Vf by a distance ΔDf obtained by the following equation 6 (ΔDf=ΔVf×t) described in the related art.

That is, as shown in FIG. 5, the shot positions of the ink drops 300*f* from the recording-head 30 deviate from the shot positions Pi by ΔDf in the moving-direction of the head.

As shown in FIG. 3, in the position (3/2)πr in the backward movement, the recording-head 30 has a movement speed (Vr−ΔVr) obtained by subtracting ΔVr from the set movement speed Vr. In this case, the time for shooting the ink drops 300*r* ejected from the recording-head 30 onto the recording-medium 200 is similar to the time t obtained by the equation 1.

Moreover, in the backward movement the ink drops 300*r* are ejected from the recording-head 30 which is moving at the movement speed (Vr−ΔVr). Therefore, the shot positions of the ink drops 300*r* deviate from the shot positions Pi in the movement at the set movement speed Vr by a distance ΔDr obtained by the following equation 7'.

$$\Delta Dr=(-\Delta Vr)\times t \qquad \text{Equation 7'}$$

That is, as shown in FIG. 5, the shot positions of the ink drops 300*r* from the recording-head 30 deviate from the shot positions Pi by ΔDr in the direction opposite to the moving-direction of the head.

As described above, in the position (3/2)πr, the ink drops 300*f*, 300*r* ejected from the recording-head 30 are shot in the same position in the main scanning direction. Therefore, the ink-dot-line by the shot ink drops 300*f*, 300*r* is formed substantially linearly along the sub scanning direction. The ink-dot-line is formed in a small width in the main scanning direction.

In the constitution as described above, in the image-recording apparatus 1 of the first embodiment, the carriage 20 is supported on the endless belt so that the position of the carriage on the endless belt can move along the main scanning direction. The position of the carriage 20 on the endless belt during the backward movement is moved by a distance πr along the main scanning direction in the reverse area ZR with respect to the forward movement. Therefore, the speed fluctuation of the carriage 20 during the backward movement deviates from the speed fluctuation during the forward movement by a ½ period. In other words, the phase of the speed fluctuation of the carriage during the backward movement of the carriage 20 deviates from the phase of the speed fluctuation during the forward movement of the carriage 20 by π radian.

Therefore, the recording-head 30 can substantially linearly record the ink-dot-line in any position along the main scanning direction. In other words, the recording-head 30 can constantly record the ink-dot-line having a small width along the main scanning direction. Therefore, there is no difference in a spread along the main scanning direction between the ink-dot-lines in the image formed by the image-recording apparatus 1. Therefore, an ordinary person does not recognize the presence of the density difference in the image. Therefore, the image-recording apparatus 1 reduces or prevents generation of density unevenness (color unevenness) in the recorded image even with the speed fluctuation of the recording-head by the eccentricity of the pulley 11 and motor 13. Therefore, the image-recording apparatus 1 can be recorded a high-precision image.

Additionally, in the first embodiment, the support hole 15 of the carriage support portion 14 has a size along the main scanning direction so that the carriage connection portion 21 can move by πr along the main scanning direction. However, this size is not limited as long as the carriage can be reciprocated so as to allow the phase of the speed fluctuation of the carriage to deviate during the forward and backward movements. That is, the size of the main scanning direction of the support hole 15 is optional with the size other than size integer times 2πr. In this case, in each desired shot position along the main scanning direction, the width of the ink-dot-line along the main scanning direction can be reduced as compared with the case in which the speed fluctuation is completely in the same phase during the forward and backward movements as in the image-recording apparatus described in the related art. Therefore, when the support hole 15 has a size other than size integer times 2πr along the main scanning direction, the image-recording apparatus 1 can reduce the generation of the density unevenness (color unevenness) in the recorded image and can record a high-quality image even with the speed fluctuation of the recording-head by the eccentricity of the pulleys 11 and motor 13. Additionally, in the first embodiment, the support hole 15 preferably has a size along the main scanning direction such that the carriage connection portion 21 can move by πr along the main scanning direction in the hole 15.

Figure 6:
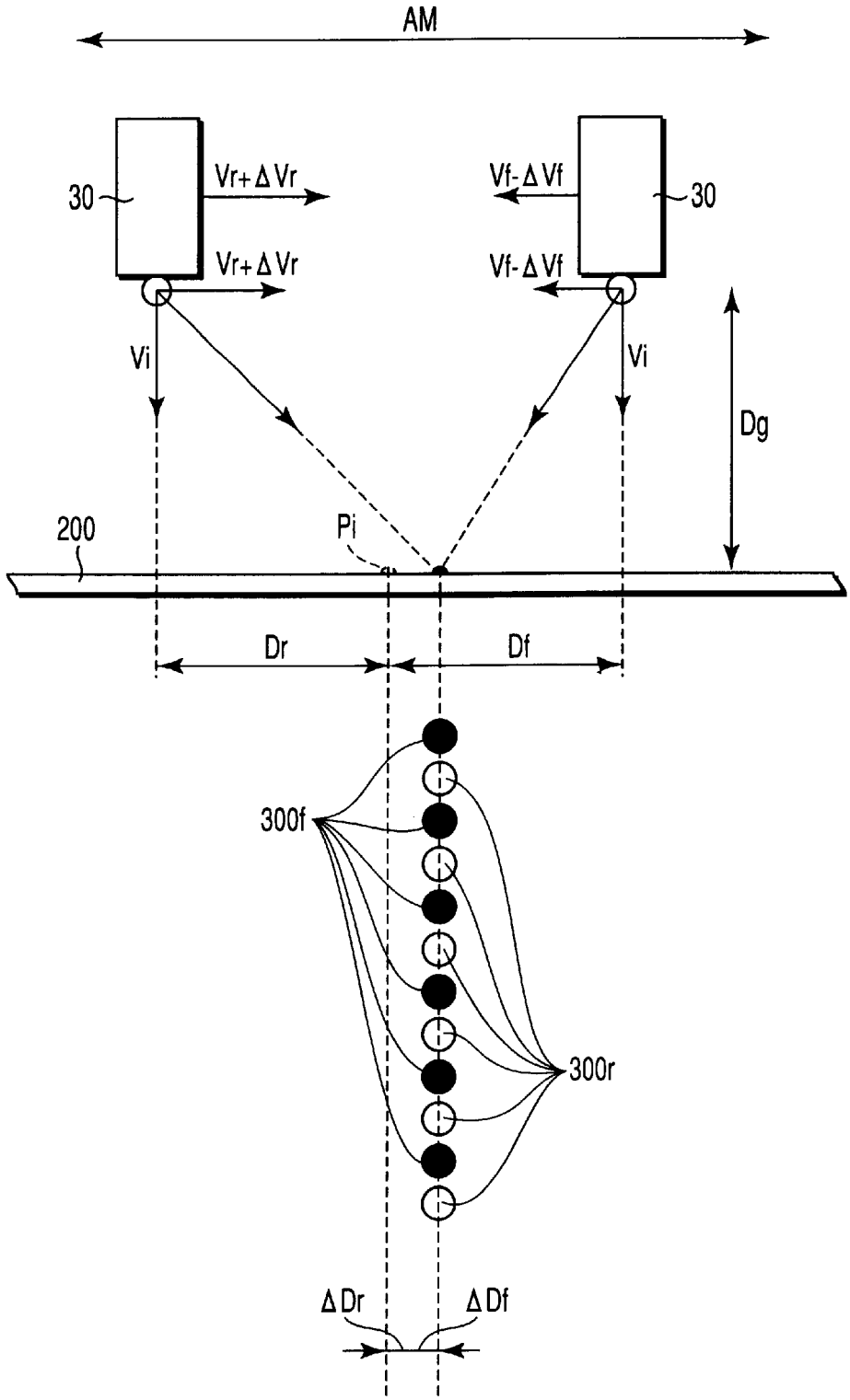
FIG. 6 is a diagram showing shot positions of ink drops ejected by the recording-head moving in a period of the speed fluctuation shown in FIG. 3 in the position (½)πr with an image-recording apparatus which records the image in a two-paths reciprocating print mode.

Moreover, in the first embodiment, the case in which the recording mode of the image-recording apparatus 1 is the one path reciprocating print mode has been described. However, the recording mode of the image-recording apparatus of the first embodiment can be a multi-path reciprocating print mode. The multi-path reciprocating print mode is a print mode for scanning the recording-head in the same position in the sub scanning direction a plurality of times and recording the image. In the multi-path reciprocating print mode, the image-recording apparatus 1 records the image in a two-paths reciprocating print mode for scanning the recording-head in the same position in the sub scanning direction twice and recording the image. The shot position of the ink in this case will be described with reference to FIG. 6. FIG. 6 is a diagram showing the shot positions of the ink drops ejected by the recording-head 30 moving in a period of the speed fluctuation shown in FIG. 3 in the movement in the position (½)πr in FIG. 3 with the image-recording apparatus 1 which records the image in the two-paths reciprocating print mode.

In the position (½)πr in the forward movement, similarly as the one path reciprocating print mode, the shot positions of the ink drops 300*f* deviate by the distance ΔDf obtained by the above equation 4 ($\Delta Df=(-\Delta Vf)\times t$).

That is, as shown in FIG. 6, the shot positions of the ink drops 300*f* deviate from the shot positions Pi by ΔDf in a direction opposite to the moving-direction of the head.

In the position (½)πr in the backward movement, similarly as the one path reciprocating print mode, the shot positions of the ink drops 300*r* deviate by the distance ΔDf obtained by the above equation 5' ($\Delta Dr=\Delta Vr\times t$).

That is, as shown in FIG. 6, the shot positions of the ink drops 300*r* deviate from the shot positions Pi by ΔDr in the moving-direction of the head.

As described above, even when the image-recording apparatus 1 records the image in the two-paths reciprocating print mode, the ink drops 300*f*, 300*r* ejected from the recording-head 30 are shot in the same position in the main scanning direction. Therefore, the ink-dot-line by the shot ink drops 300*f*, 300*r* is formed substantially linearly along the sub scanning direction.

Moreover, in the first embodiment, the position of the carriage 20 on the endless belt 12 is moved, so that the phase of the speed fluctuation of the carriage deviates during the forward and backward movements. However, the recording-head 30 may be constituted to be slidable, and it is also possible to move the recording-head 30 along the main scanning direction.

Furthermore, in the first embodiment, the carriage connection portion 21 is directly supported by an inner wall of the support hole 15. However, the carriage connection portion 21 may also be supported by the inner wall via a friction reduction member for reducing vibration by friction generated during the sliding of the portion. The friction reduction member, such as a rail, is disposed over the whole main scanning direction of the inner wall of the support hole 15. The friction reduction member is not limited to the rail, and also includes various coatings for the inner wall such that the friction can be reduced. The friction reduction member is optional as long as the member is a known friction reduction member capable of reducing friction between the inner wall and the carriage connection portion 21.

Furthermore, for the support hole 15, to damp impact during contact of the carriage connection portion 21 with the ends of the support hole 15, buffer members such as a damper may be disposed in the opposite ends of the hole along the main scanning direction. Examples of the buffer members include not only the damper but also known elastic members such as various rubbers and springs.

Additionally, to damp impact in the contact of the carriage connection portion 21 with the end of the support hole 15, the control section 40 preferably decelerates the movement speed of the carriage 20 during a reverse action of the moving-direction of the carriage support portion 14. For example, during the reverse action, the control section 40 starts the motor 13 with a rotation number sufficiently smaller than the rotation number in the image-recording area ZP, and brings the carriage connection portion 21 in soft contact with the end of the support hole 15. Thereafter, the control section 40 controls the motor 13 so as to gradually raise the rotation number of the motor 13 up to the rotation number in the image-recording area ZP. Moreover, to damp the impact, the control section 40 slows the rotation of the motor 13, when the carriage 20 enters the reverse area ZR. Alternatively, the control section 40 can control the mortar 13 to stop the rotating/driving so that the portion 21 contacts the opposite end of the support hole 15 during inertia movement of the carriage 20.

(Second Embodiment)

Figure 7:
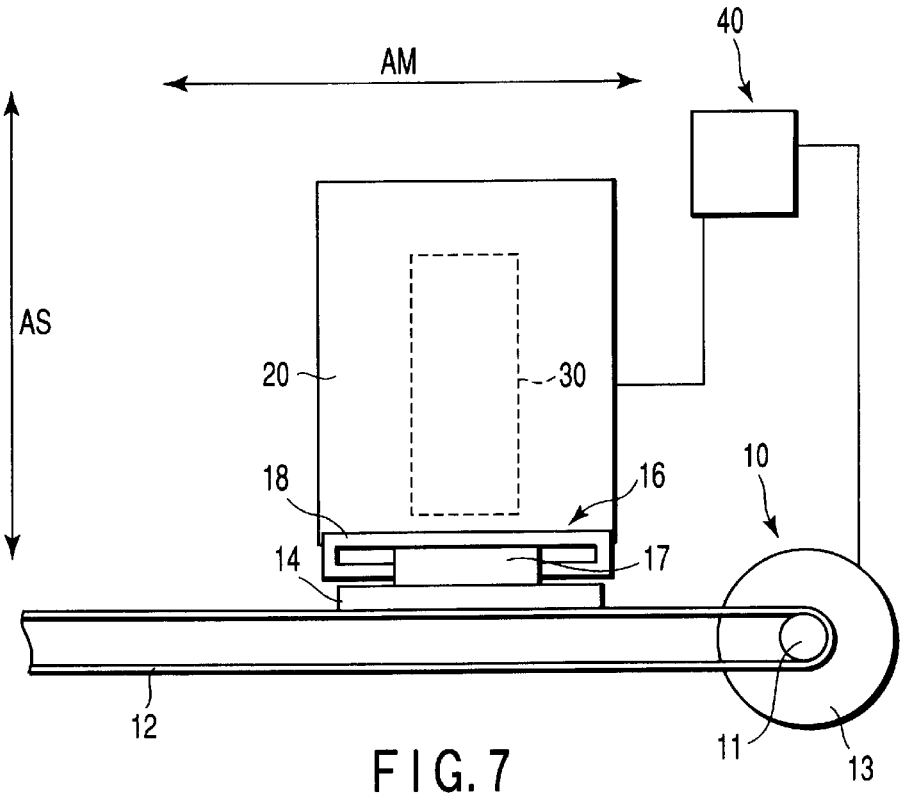
FIG. 7 is an enlarged side view showing the carriage support portion 14 according to a second embodiment.
Figure 12:
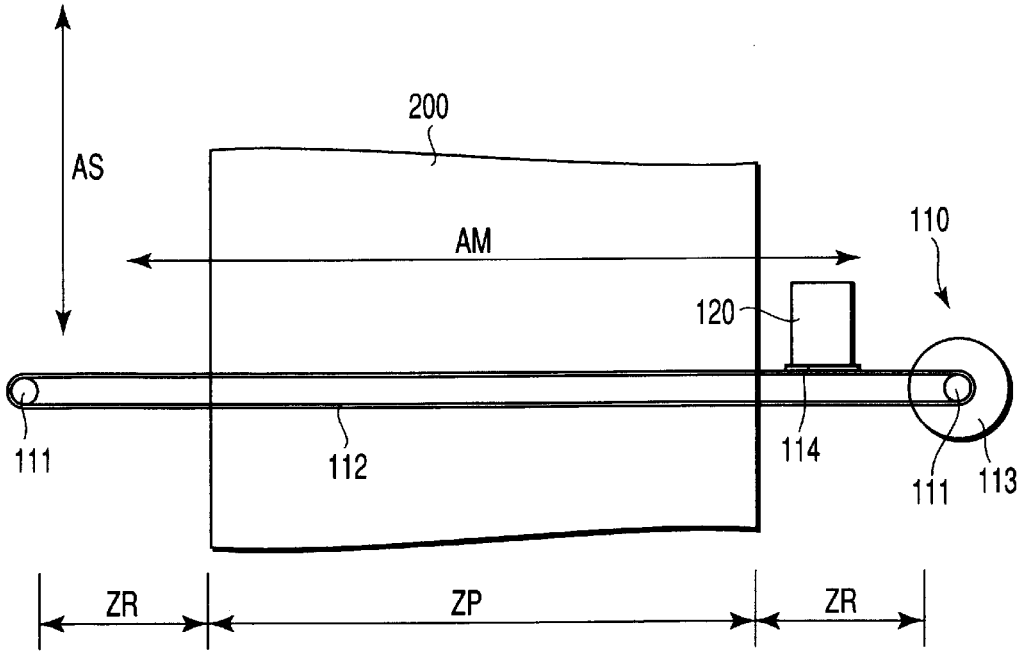
FIG. 12 PRIOR ART
FIG. 12 is a side view showing a conventional image-recording apparatus.

A second embodiment of the present invention will be described hereinafter with reference to FIG. 7. FIG. 7 is an enlarged side view showing the carriage support portion 14 according to the second embodiment. The image-recording apparatus 1 of the second embodiment is different from that of the first embodiment in the constitution of the carriage support portion 14.

The carriage support portion 14 includes solenoid driving mechanism 16 for adjusting the position of the carriage 20. The solenoid driving mechanism 16 includes a coil 17 and movable portion 18. The coil 17 extends in the main scanning direction, and is fixed to the carriage support portion 14. The carriage 20 is fixed to the movable portion 18, and the portion 18 can move along the main scanning direction by an electromagnetic driving force-of the coil 17. Therefore, the solenoid driving mechanism 16 is fixed to the carriage support portion 14, and reciprocates the movable portion 18 along the main scanning direction by the electromagnetic driving force by the control of the control section 40. Additionally, in the second embodiment, for the solenoid driving mechanism 16, a movable range of the movable portion 18 along the main scanning direction is set to πr. The movable portion 18 is movably connected to the coil 17, and fixes the carriage 20. Therefore, the carriage support portion 14 moves the carriage 20 with the movement of the movable portion 18 by the solenoid driving mechanism 16.

The action of the image-recording apparatus 1 according to the second embodiment will be described hereinafter.

In the image-recording apparatus 1 of the second embodiment, the solenoid driving mechanism 16 moves movable portion 18 to one end of the movable range along the main scanning direction before the movement start. Subsequently, similarly as the first embodiment, the image-recording apparatus 1 of the second embodiment reciprocates the carriage 20, ejects the ink to the recording-head 30 and records the image.

After moving in the image-recording area ZP, the carriage 20 enters the reverse area ZR opposite to that of the start time. When the carriage 20 enters the reverse areas ZR, the solenoid driving mechanism 16 moves the movable portion 1 to the other end of the movable range along the main scanning direction. By the above-described action, in the image-recording apparatus 1 of the second embodiment, similarly as the first embodiment, the position of the carriage 20 on the endless belt in the forward movement can deviate from the position in the backward movement by $\pi r$. Thereby, the recording-head 30 of the image-recording apparatus 1 can substantially linearly record the ink-dot-line in the shot position of each ink along the main scanning direction. In other words, each ink-dot-line is formed with a small width in the main scanning direction. Therefore, in the image-recording apparatus 1, even when the speed of the recording-head 30 fluctuates because of the eccentricity of the pulleys 11 and motor 13, the density unevenness (color unevenness) in the recorded image is reduced or prevented from being generated, and the high-quality image can be recorded.

Additionally, in the second embodiment, in order to move the position of the carriage 20 on the endless belt, the solenoid driving mechanism 16 is used. However, the solenoid driving mechanism 16 can be replaced by another known translation driving means as long as the position of the carriage 20 on the endless belt 12 in forward movement can deviate from that in the backward movement by the distance along the main scanning direction in the reverse area ZR. Examples of the known translation driving means include driving means by a combination of a motor and belt.

(Third Embodiment)

The image-recording apparatus 1 according to a third embodiment will be described hereinafter. The image-recording apparatus 1 of the third embodiment is different from the image-recording apparatus 1 of the second embodiment in the constitution of the solenoid driving mechanism 16.

The solenoid driving mechanism 16 of the third embodiment is constituted such that the movable range of the movable portion 18 along the main scanning direction is set to $3/2\pi r$ and the position of the movable portion 18 can be held in the optional position along the main scanning direction.

An action of the image-recording apparatus 1 for recording the image in a four-paths reciprocating print mode according to the third embodiment will be described hereinafter. The four-paths reciprocating print mode is an image recording mode for scanning the recording-head four times to record the image in the same position in the sub scanning direction.

In the image-recording apparatus 1 of the third embodiment, the solenoid driving mechanism 16 moves the movable portion 18 to one end of the movable range along the main scanning direction before starting the movement. Subsequently, similarly as the first embodiment, the image-recording apparatus 1 of the third embodiment reciprocates the carriage 20 (first path movement) and allows the recording-head 30 to eject the ink and record the image.

After moving in the image-recording area by the forward movement, the carriage 20 enters the reverse area ZR opposite to that of the start time. When the carriage 20 enters the reverse areas ZR by the movement, the solenoid driving mechanism 16 moves the movable portion 18 toward the other end of the movable range by the distance of the carriage in (¼) of the speed fluctuation period of the carriage 20, that is, $(\frac{1}{2})\pi r$. Then, the solenoid driving mechanism 16 holds the movable portion 18 at the position being apart form the one end of the movable range by $(\frac{1}{2})\pi r$. When the movable portion 18 is held, the image-recording apparatus 1 conveys the recording-medium 200 by an amount corresponding to ¼ of the recording width of the head.

Subsequently, the carriage 20 starts the backward movement (second-path movement), and the recording-head 30 records the image. When the carriage 20 enters the reverse area ZR by the movement, the solenoid driving mechanism 16 further moves the movable portion 18 toward the other end by $(\frac{1}{2})\pi r$, and holds the portion in the position. Subsequently, the recording-medium 200 is conveyed by the amount corresponding to ¼ of the recording width of the head. Similarly, every time the carriage 20 enters the reverse area ZR by a third-path or fourth-path reciprocating movement, the solenoid driving mechanism 16 moves the movable portion 18 toward the other end of the movable range by $(\frac{1}{2})\pi r$, and holds the portion in the position. Moreover, the recording-medium 200 is conveyed by the amount corresponding to ¼ of the recording width of the head after each movement of the carriage 20. After the fourth-path movement, the movable portion 18 is positioned on the other end of the movable range. In the each path of the first- to fourth-path movements, a distance of the movable portion 18 from the one end of the movable range, is as shown in the following;

first-path: 0 (one end), second-path: $(\frac{1}{2})\pi r$, third-pass: $\pi r$, fourth-path: $(3/2)\pi r$ (the other end)

Upon ending the conveyance, the image-recording apparatus again performs the reciprocating movement for four paths and records the image as described above. Additionally, in this case, the movable portion 18 is positioned on the other end of the movable range, and cannot further move toward the other end from the one end. Therefore, the movable portion 18 is moved in the opposite direction (from the other end to one end) in each reverse area ZR by $(\frac{1}{2})\pi r$ for each path. For more detail, in the follow reciprocating movement, carriage 20 is positioned at the other end of the movable range in the first-path movement. The carriage 20 is moved by $(\frac{1}{2})\pi r$ from the other end toward the one end in every path of the second- to the fourth-path movements. In the each path of the first- to fourth-path movements in the follow reciprocating movement, a distance of the movable portion 18 from the one end of the movable range, is as shown in the following; first-path: $(3/2)\pi r$ (the other end), second-path: $\pi r$, third-pass: $(\frac{1}{2})\pi r$, fourth-path: 0 (one end).

Figure 8:
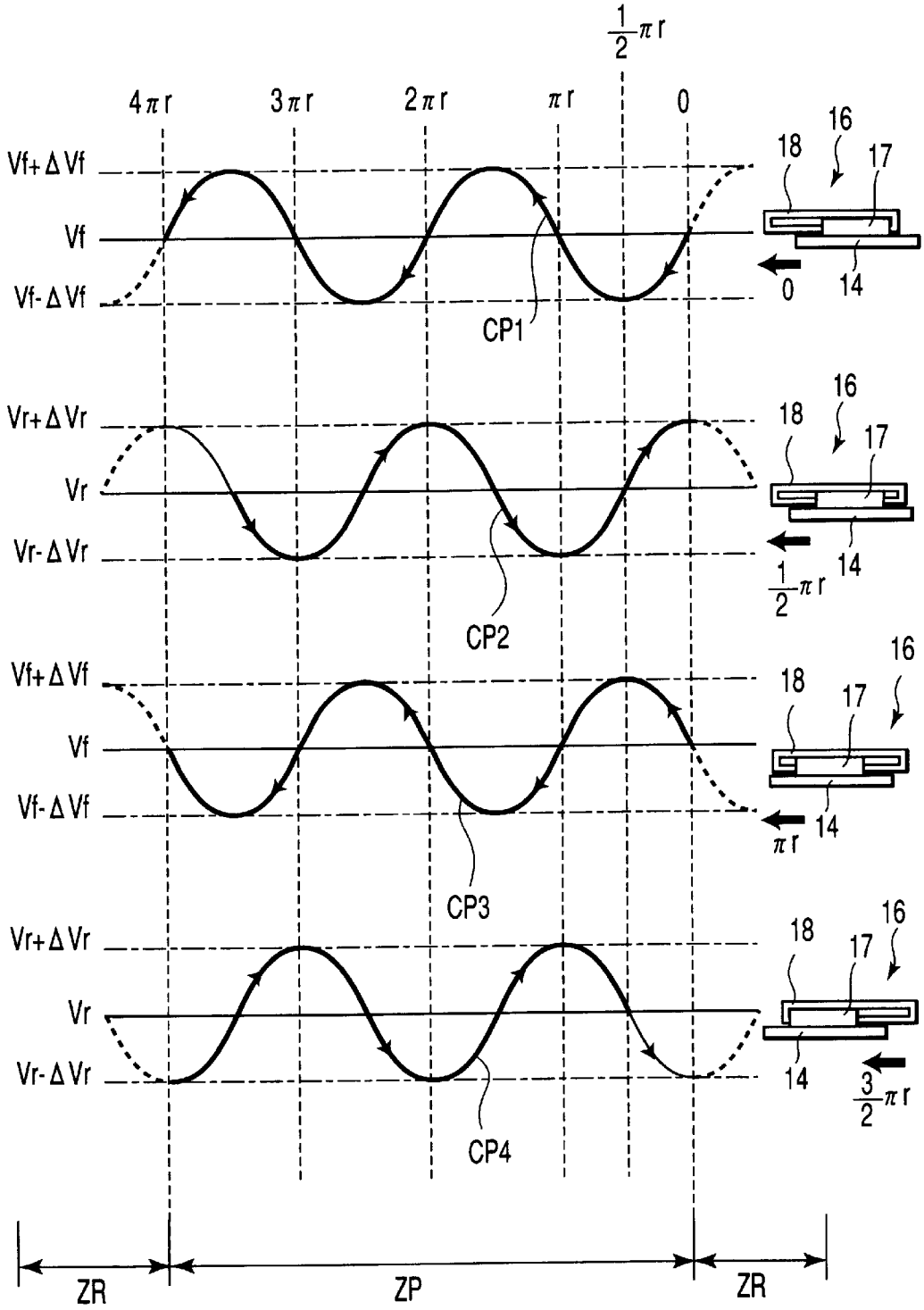
FIG. 8 is a graph showing the speed fluctuation of the carriage in the second embodiment, whose abscissa indicates the position of the carriage in the main scanning direction and whose ordinate indicates the speed of the carriage.

The image-recording apparatus 1 of the third embodiment repeats the above-described action and thereby records the images. The speed fluctuation of the carriage 20 moved by the action will be described hereinafter with reference to FIG. 8. FIG. 8 is a graph showing the speed fluctuation of the carriage 20 in the third embodiment, whose abscissa indicates the position of the carriage 20 in the main scanning direction and whose ordinate indicates the speed of the carriage 20.

In FIG. 8, the speed fluctuation of the carriage 20 in the first path is shown by a curve CP1, and similarly speed fluctuations of the carriage 20 in the second, third, and fourth paths are shown by curves CP2, CP3, CP4.

As described above and shown in FIG. 8, the period of the speed fluctuation of the carriage 20 in each path deviates from the period of the speed fluctuation in the next path by a (¼) period. Therefore, at the respective positions from the position 0 as shown FIG. 8 by a distance integer times (½)πr in the image-recording area ZP, when the movement speeds of the carriage 20 in the first to fourth paths are compared, all the speeds are not the same. Therefore, the ink-dot-line formed in the each position is securely formed with a substantially constant width in the main scanning direction. Therefore, in the recorded ink-dot-lines, the linearly formed lines and the lines having the width do no exist in the mixed manner. Even when the speed of the recording-head fluctuates, the density unevenness (color unevenness) in the recorded image is reduced or prevented from being generated, and the image-recording apparatus 1 can record the high-quality image.

Additionally, in the third embodiment, the image-recording apparatus 1 records the image in the four-paths reciprocating print mode. And the image-recording apparatus 1 deviates the period of the speed fluctuation of each path from that of the previous path by the (¼) period. However, the image-recording apparatus 1 of the third embodiment is not limited to the four-paths reciprocating print mode. For example, In two paths reciprocating print mode, the each of the period in the two paths is shifted by ½ of the period, each other. With the reciprocating print in X paths, the solenoid driving mechanism 16 is controlled in such a manner that each path deviates from the previous path by a (1/X) period of the speed fluctuation. Then, the effect similar to the third embodiment is obtained. In other words, with the reciprocating print in X paths, the image-recording apparatus of the third embodiment is controlled in such a manner that the phase of the speed fluctuation of the carriage during the movement of the next carriage deviates from the phase of the speed fluctuation during the previous carriage movement by (1/X)2π radian. Then, the number of the paths is not limited.

In the each path of the first- to fourth-path movements, the solenoid driving mechanism 16 drives the carriage 20 to move in the main scanning direction by (½)πr between the one end and the other end of the movable range, however the carriage 20 can randomly move from one of the predetermined positions to another within the movable range.

(Fourth Embodiment)

Figure 9:
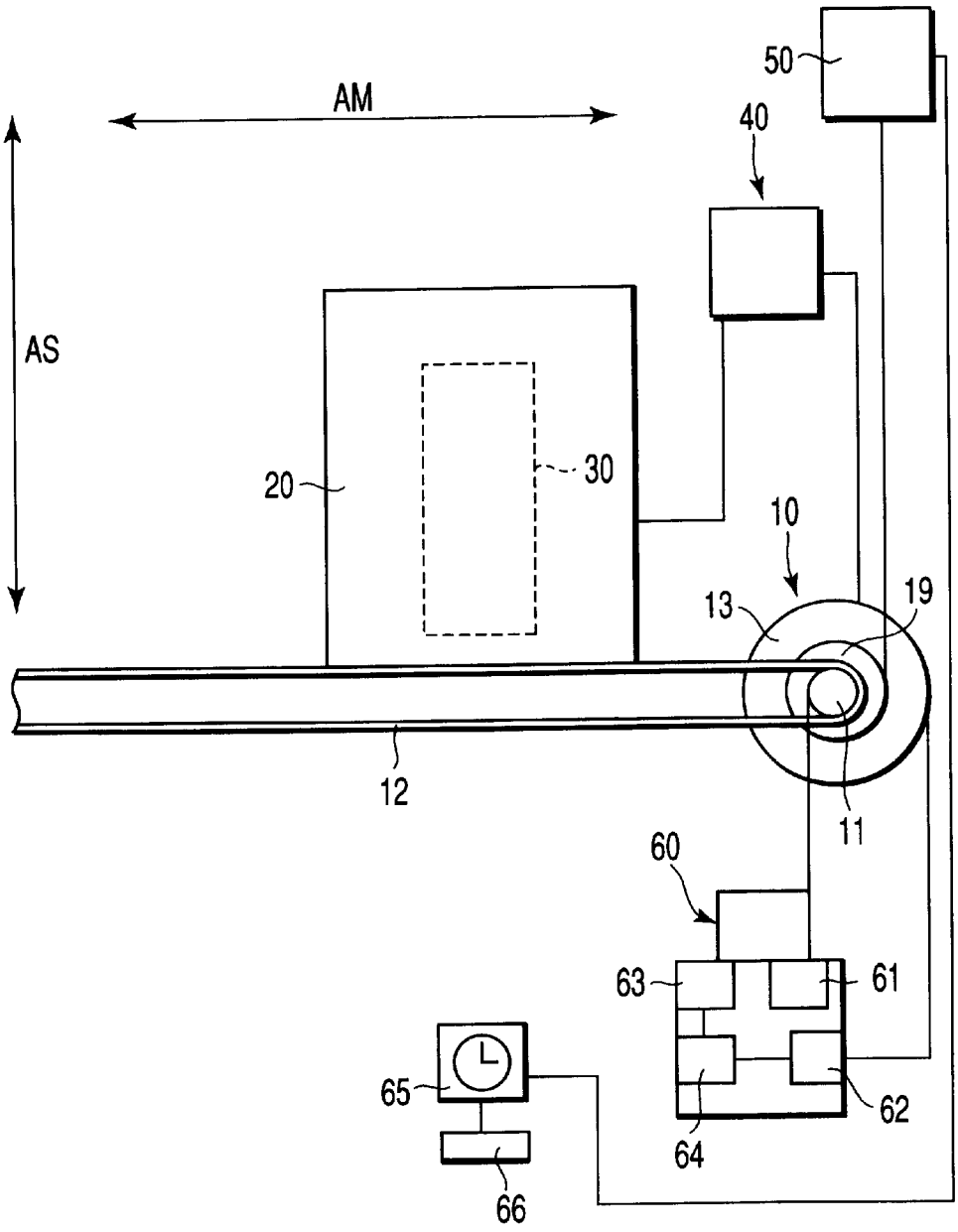
FIG. 9 is a schematic side view showing carriage-driving mechanism according to a fourth embodiment.

The image-recording apparatus 1 according to a fourth embodiment will be described hereinafter. The image-recording apparatus 1 of the fourth embodiment is different from the apparatus according to the first to third embodiments in that the carriage 20 is fixed onto the endless belt 12. Moreover, the carriage-driving mechanism 10 of the fourth embodiment includes a clutch 19, clutch control circuit 50, pulley rotation detection sensor 61, and motor rotation detection sensor 62. FIG. 9 is a schematic side view showing the carriage-driving mechanism 10 according to the fourth embodiment.

The clutch 19 is disposed between the motor 13 and the pulley 11 to which the driving force of the motor 13 is transmitted. The clutch 19 connects the pulley 11 and motor 13. When the clutch 19 connects the pulley 11 and motor 13, the clutch 19 selectively transmits the driving force of the motor 13 to pulley 11.

The clutch control circuit 50 issues a command to the clutch 19, and controls on/off of the connection between the pulleys 11 and motor 13.

The pulley rotation detection sensor 61 counts the rotation number of each pulley 11. The motor rotation detection sensor 62 counts the rotation number of the motor 13. The pulley rotation detection sensor 61 and motor rotation detection sensor 62 cooperate with each other to configure rotation difference detection sensor 60.

The action of the image-recording apparatus 1 according to the fourth embodiment will be described hereinafter.

As described later, the image-recording apparatus 1 of the fourth embodiment operates the clutch 19, forms a relative rotation difference between the pulleys 11 and motor 13. The speed fluctuation of the carriage 20 in the backward movement is shifted to the rotation difference in the forward movement.

After moving in the image-recording area ZP during the forward movement, the carriage 20 enters the reverse area ZR opposite to that of the start time. When the carriage 20 enters the reverse area ZR, the clutch control circuit issues the command to the clutch 19, and turns off the connection between the pulley 11 and motor 13. Subsequently, the rotation difference detection sensor 60 detects that the difference of relative rotation amounts between the pulley 11 and motor 13 after the turning-off of the clutch 19 is odd-number times the amount of ½ rotation. When the rotation difference detection sensor 60 detects the rotation difference in this manner, the clutch control circuit 50 issues a command for turning on the clutch.

Concretely, first, when the carriage 20 is in the reverse area ZR, the clutch control circuit 50 turns off the clutch 19. Thereby, the driving force of the motor 13 is not transmitted to the pulley 19, but the carriage 20 continues to be moved in the main scanning direction with inertia. Therefore, the pulley 11 continues rotating. Additionally, in this case, the pulley rotation detection sensor 61 counts the rotation amount of the pulley 11 after the clutch 19 is turned off. Moreover, the control section 40 maintains the rotation of the motor 13. In this case, the motor rotation detection sensor 62 counts the rotation amount of the motor 13 after the clutch 19 is turned off. Moreover, the clutch control circuit 50 compares the rotation amounts of the pulley 11 and motor 13 counted by the pulley rotation detection sensor 61 and motor rotation detection sensor 62. The clutch control circuit 50 turns on the clutch, when the difference of the rotation amounts is odd-number times the amount of ½ rotation.

By the above-described clutch operation, in the image-recording apparatus 1 of the fourth embodiment, similarly as the first embodiment, the phase of the speed fluctuation of the carriage moved in the backward movement can be shifted from the phase of the speed fluctuation of the carriage 20 moved in the forward movement by odd-number times the X radian. Thereby, the recording-head 30 can record the ink-dot-line substantially linearly in each shot position. In other words, each ink-dot-line is formed in a small width in the main scanning direction. Therefore, in the image-recording apparatus 1, even when the speed of the recording-head 30 fluctuates because of the eccentricity of the motor 13, the density unevenness (color unevenness) in the recorded image is reduced or prevented from being generated, and the high-quality image can be recorded.

Additionally, in the fourth embodiment, when the carriage 20 is in the reverse area ZR and performs inertial movement, the control section 40 and clutch control circuit 50 execute the control. However, when the control section 40 and clutch control circuit 50 can be controlled so as to make a difference in the relative rotation amount between the pulley 11 and motor 13 by odd-number times the amount of ½ rotation, the timing of the control is not limited. For example, the clutch control circuit 50 turns off the clutch 19 while the carriage 20 is stopped, and the control section 40 and clutch control circuit 50 control the motor 13 and the clutch 19 so as to make the rotation difference. In this case, since the pulley rotation detection sensor 61 is unnecessary, the carriage-driving mechanism 10 can more simply be constituted.

Moreover, the difference of the rotation amount between the pulley 11 and motor 13 is made by the clutch is turned on/off before the moving-direction is reversed in the reverse area ZR. However, the difference of the rotation amount can be made by turning on/off the clutch, before the carriage again enters the image-recording area ZP after the moving-direction is reversed.

Furthermore, in the fourth embodiment, the pulley 11 and motor 13 are controlled to have the difference of the relative rotation amount which is odd-number times the amount of ½ rotation. However, the difference of the rotation amount is not limited. The pulley 11 and motor 13 may be controlled so as to have the difference of the rotation amount so that the phase of the speed fluctuation of the carriage 20 in the forward movement deviates from that in the backward movement. That is, the pulley 11 and motor 13 may only be controlled so as to have the difference of the rotation amount other than the rotation amount integer times the amount of one rotation. When the pulley 11 an motor 13 are controlled in this manner, in the image-recording apparatus 1 of the fourth embodiment, the width of the recorded ink-dot-line along the main scanning direction can be small as compared with the case in which the speed fluctuation is completely in the same phase during the forward and backward movements. Therefore, in the image-recording apparatus, even when the speed of the recording-head fluctuates by the eccentricity of the movement, the density unevenness (color unevenness) in the recorded image is reduced or prevented from being generated, and the high-quality image can be recorded.

Furthermore, in the image-recording apparatus 1 of the fourth embodiment, when the image is recorded in the multi-path reciprocating print mode, similarly as the third embodiment, it is possible to make the difference of the rotation amount such that the speed fluctuation of each path deviates from that of the previous path by the (1/X) period during the reciprocating print in the X paths. Thereby, the recorded ink-dot-lines do not include the linearly formed lines and the lines having the widths in the main scanning direction in the mixed manner. Therefore, even with the speed fluctuation of the recording-head, the density unevenness (color unevenness) is reduced or prevented from being generated in the recorded image, and the high-precision image can be recorded.

(Fifth Embodiment)

The image-recording apparatus 1 according to a fifth embodiment will be described hereinafter. The image-recording apparatus 1 of the fifth embodiment is different from that of the fourth embodiment. In this embodiment, the carriage-driving mechanism 10 includes position detection sensor 63 for detecting the position of the carriage 20 along the main scanning direction and an operation circuit 64, instead of the pulley rotation detection sensor 61.

The operation circuit 64 detects a difference between a movement distance of the carriage 20 corresponding to the rotation amount of the motor 13 after the clutch 19 is turned off, and a movement distance of the carriage 20 detected by the position detection sensor 63 after the clutch 19 is turned off. Moreover, the image-recording apparatus 1 controls the on/off of the clutch based on two movement distances of the carriage 20. Thereby the phase of the speed fluctuation of the carriage 20 in the backward movement is shifted to the phase of the speed fluctuation in the forward movements.

Concretely, first, when the carriage 20 is in the reverse area ZR, the clutch control circuit 50 turns off the clutch 19. Thereby, the driving force of the motor 13 is not transmitted, but the carriage 20 continues the inertial movement in the main scanning direction. Therefore, the pulley 11 continues rotating. Additionally, in this case, the position detection sensor 63 starts measuring the movement distance of the carriage 20 after the clutch 19 is turned off. Moreover, the control section 40 maintains the rotation of the motor 13. The motor rotation detection sensor 62 counts the rotation amount of the motor 13 after the clutch 19 is turned off. The operation circuit 64 obtains the moving distance of the carriage 20 by the rotation number counted by the rotation detection sensor 62. Subsequently, when the difference between the distance obtained by the position detection sensor 63 and the distance obtained by the rotation number is a predetermined distance, the operation circuit 64 issues the command to the clutch control circuit 50. The predetermined distance is a distance in which the carriage 20 is moved by a rotation odd-number times the ½ rotation of the motor 13. In response to the command, the clutch control circuit 50 turns on the clutch.

By the above-described clutch operation, in the image-recording apparatus 1 of the fifth embodiment, similarly as the fourth embodiment, the phase of the speed fluctuation of the carriage moved in the backward movement can be shifted from the phase of the speed fluctuation in the forward movement by odd-number times the $\pi$ radian. Thereby, the recording-head 30 can record the ink-dot-line substantially linearly in each shot position. In other words, each ink-dot-line is formed in the small width in the main scanning direction. Therefore, in the image-recording apparatus 1, even when the speed of the recording-head 30 fluctuates because of the eccentricity of the motor 13, the density unevenness (color unevenness) in the recorded image is reduced or prevented from being generated, and the high-quality image can be recorded.

(Sixth Embodiment)

The image-recording apparatus 1 according to a sixth embodiment will be described hereinafter. The image-recording apparatus 1 of the sixth embodiment is different from the fourth embodiment in that the carriage-driving mechanism 10 includes a timer 65 and memory 66 instead of the pulley rotation detection sensor 61.

The timer 65 measures a time for which the clutch 19 is off in the reverse area ZR.

The memory 66 is stored a time beforehand. It is the time from a defined timing until the difference of the rotation amount between the pulley 11 and motor 13 is odd-number times the rotation amount of ½ rotation in the reverse area ZR.

In the image-recording apparatus 1 of the sixth embodiment, the clutch control circuit 50 turns off the clutch 19 in the defined timing, when the carriage 20 is in the reverse area ZR. For example, the defined timing is a moment in which predetermined time elapses after the carriage 20 entered the reverse area ZR. Moreover, the clutch control circuit 50 controls the clutch so that the clutch is off for a time set in the memory 66. Therefore, the difference of the rotation amount between the pulley 11 and motor 13 is odd-number times the amount of ½ rotation. Therefore, the carriage-driving mechanism 10 reciprocates the carriage so that the phase of the speed fluctuation of the carriage during the forward movement deviates from that during the backward movement by odd-number times the $\pi$ radian. Therefore, the recording-head can record the ink-dot-line substantially linearly in each desired position. In other words, each ink-dot-line is formed with the small width in the main scanning direction.

Additionally, in the sixth embodiment, the memory 66 stores the time in which the difference of the rotation amount between the pulley 11 and motor 13 is odd-number times the amount of ½ rotation in the reverse area ZR. However, the stored time may be other than the time in which the difference of the rotation amount is odd-number times the amount of ½ rotation. For example, with the driving of the image-recording apparatus 1 in the four-paths reciprocating print mode, the time can be set to the time in which the difference of the rotation amount is integer times the amount of ¼. In this case, it is possible to form the ink-dot-line described above in the third embodiment. In this case, the image-recording apparatus 1 can obtain an effect similar to that of the third embodiment.

(Seventh Embodiment)

Figure 10:
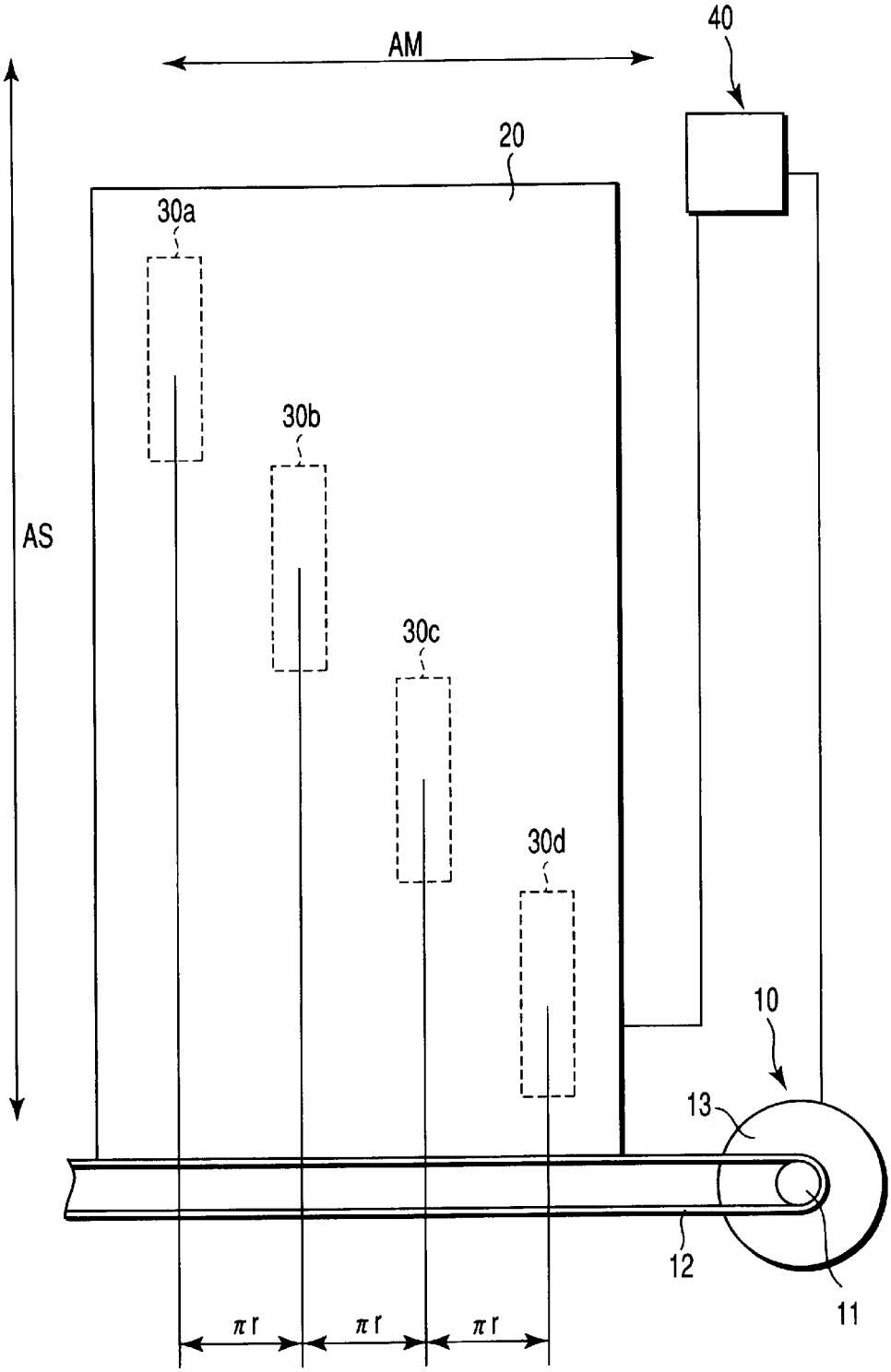
FIG. 10 is a schematic side view showing the recording-head according to a seventh embodiment.

The image-recording apparatus 1 according to a seventh embodiment will be described hereinafter with reference to FIG. 10. FIG. 10 is a schematic side view showing the recording-head 30 according to the seventh embodiment. The image-recording apparatus 1 of the seventh embodiment is different from that of the first to sixth embodiments in that the apparatus is disposed along the conveying direction of the recording-medium (sub scanning direction: vertical direction in FIG. 10) as shown in FIG. 10. Additionally, the image-recording apparatus 1 of the seventh embodiment includes a plurality of recording-heads 30 arranged along the main scanning direction. Moreover, the carriage 20 is fixed on the endless belt 12.

The plurality of recording-heads 30 are arranged so that an interval between the adjacent recording-heads 30 along the main scanning direction is a distance corresponding to odd-number times the distance of movement of the carriage 20 during the ½ period of the speed fluctuation. That is, as shown in FIG. 10, each recording-head 30 is disposed apart from the adjacent recording-head 30 by a distance of $\pi r$. Moreover, each recording-head 30 is disposed apart from the adjacent recording-head 30 by one pitch of the jet port in the sub scanning direction so that the ink jet ports of all the recording-heads 30 are arranged at constant pitches in the sub scanning direction. Therefore, the recordable areas in the sub scanning direction of the recording-heads are adjacent to one another without being overlapped in the sub scanning direction.

Particularly in FIG. 10, these recording-heads 30 are denoted with reference characters 30*a*, 30*b*, 30*c*, 30*d* in order from the top recording-head 30 (the left recording-head 30 in FIG. 10) along the moving-direction of the forward movement. Additionally, the recording-heads 30 of the seventh embodiment are arranged for color print. Concretely, the recording-head 30*a* is constituted to eject a black ink, the recording-head 30*b* is to eject a cyan ink, the recording-head 30*c* is to eject a magenta ink, and the recording-head 30*d* is to eject a yellow ink.

The action of the image-recording apparatus 1 according to the seventh embodiment will be described hereinafter. Particularly the one-path reciprocating print mode of the image-recording apparatus 1 will be described.

As described in the first embodiment, for the image-recording apparatus 1, during the first forward movement, the recording-head 30*a* ejects the black ink along the main scanning direction. Subsequently, the carriage 20 enters the reverse area ZR (the reverse area ZR opposite to that of the start time), then reverses, and starts the backward movement.

Additionally, during the reverse, the control section 40 does not special control for shifting the period of the speed fluctuation of the carriage 20 in the forward movement from that in the subsequent backward movement. The special control is a control to shift the period as described in the first to fifth embodiment with respect to the carriage-driving mechanism 10. Moreover, during the reverse, the recording-medium 200 is conveyed for the recording width of the recording-head 30*a* in the sub scanning direction. Therefore, the portion in which the image is recorded by the recording-head 30*a* is moved to a position in which the image can be recorded by the recording-head 30*b* in the sub scanning direction.

Subsequently, in the backward movement, the recording-head 30*b* ejects the cyan ink. In this case, the recording-head 30*a* ejects the black ink so as to record the image in the next image-recording portion in the sub scanning direction. Additionally, the recording-head 30*b* is apart from the recording-head 30*a* by the distance of $\pi r$. Therefore, the recording-head 30*b* is moved with the speed fluctuation which deviates from the speed fluctuation of the recording-head 30*a* in the forward movement by the ½ period. Therefore, the recording-head 30*b* forms the ink-dot-line with the black ink by the forward movement, and the ink-dot-line with the cyan ink in substantially the same position in the main scanning direction. Subsequently, the carriage 20 enters the reverse area ZR (the reverse area ZR of the start time), again reverses, and starts the forward movement.

Additionally, even during the reverse, the control section 40 does not execute the above-described special control. Moreover, during the reverse, the recording-medium 200 is conveyed by the recording width of the recording-head 30*b* in the sub scanning direction. Therefore, the portion in which the image is recorded by the recording-head 30*b* is moved to the position in which the image can be recorded by the recording-head 30*c* in the sub scanning direction.

Subsequently, in the forward movement, the recording-head 30*c* ejects the magenta ink. In this case, the recording-heads 30*a*, 30*b* eject the black and cyan inks so as to record the image in the next image recording portion in the sub scanning direction. Additionally, since the recording-head 30*c* is apart from the recording-head 30*b* by the distance of $\pi r$, the recording-head is moved with the speed fluctuation deviating from the speed fluctuation of the head 30*b* in the backward movement by the ½ period. That is, the recording-head 30*c* is moved in substantially the same period of speed fluctuation as that of the recording-head 30*a* in the first forward movement, and performs the printing. Therefore, the recording-head 30*c* forms the ink-dot-lines with the black and cyan inks, and the ink-dot-line with the magenta ink in substantially the same position in the main scanning direction. Subsequently, the carriage 20 enters the reverse area ZR (the reverse area ZR opposite to that of the start time), again reverses, and starts the backward movement.

Additionally, even during the reverse, the control section 40 does not execute the above-described special control. During the reverse, the recording-medium 200 is conveyed by the recording width of the recording-head 30*c* in the sub scanning direction. Therefore, the portion in which the image is recorded by the recording-head 30*c* is moved to a position in which the image can be recorded by the recording-head 30*d* in the sub scanning direction.

Subsequently, in the backward movement, the recording-head 30*d* ejects the yellow ink. In this case, the recording-heads 30*a*, 30*b*, and 30*c* eject the respective inks so as to record the images in the next image-recording portion in the sub scanning direction. Additionally, since the recording-head 30*d* is apart from the recording-head 30*c* by the distance of $\pi r$, the recording-head 30*d* is moved with the speed fluctuation deviating from the speed fluctuation of the head 30*c* in the forward movement by the ½ period. That is, the recording-head 30*d* is moved in the substantially same period of speed fluctuation as that of the recording-head 30*b* in the first backward movement, and performs the printing. Therefore, the recording-head 30*d* forms the ink-dot-lines with the black, cyan, magenta inks, and the ink-dot-line with the yellow ink in substantially the same position in the main scanning direction. Subsequently, the carriage 20 enters the reverse area ZR (the reverse area ZR opposite to that of the start time), again reverses, and starts the forward movement.

Additionally, even during the reverse, the control section 40 does not execute the above-described special control. During the reverse, the recording-medium 200 is conveyed by the width of the recording-head 30*d* in the sub scanning direction. The portion in which the image is recorded by the recording-head 30*d* can be a completed image portion, because all the inks (black, cyan, magenta, and yellow) are applied.

As described above in the action, the control section 40 can shift the speed fluctuation by ½ period for each recording-head without executing the above-described control. Therefore, although the image-recording apparatus 1 of the present embodiment has a simple constitution, the ink-dot-lines of the respective colors can be recorded substantially linearly (with the small recording width in the main scanning direction) in the same position over the main scanning direction. Therefore, in the image-recording apparatus 1, even when the speed of the recording-head 30 fluctuates because of the eccentricity of the pulley 11 and motor 13, the color unevenness (density unevenness) is reduced or prevented from being generated in the recorded image, and the high-quality image can be recorded.

Additionally, in the present embodiment, the image-recording apparatus 1 can record the image in the same order of color superimposition in each recording portion in the sub scanning direction. Therefore, each ink-dot-line color is substantially the same, and the generation of color unevenness can be reduced as compared with a case in which the order of color superimposition is uneven.

Moreover, in the image-recording apparatus 1 of the seventh embodiment, the distance between the recording-heads disposed adjacent to each other along the main scanning direction is $\pi r$. This is a half of the distance of the conventional image-recording apparatus (Jpn. Pat. Appln. KOKAI Publication No. 1998-250028). Therefore, it is possible to miniaturize the carriage.

Additionally, the distance between the recording-heads 30 disposed adjacent to each other can be set other than the above-described distance. In this case, it is preferable to set the distance between the adjacent recording-heads 30 to be odd-number times the distance in which the carriage can move in the ½ period of speed fluctuation. However, the distance between the adjacent recording-heads 30 is not limited as long as the phase of the speed fluctuation can be shifted in the forward and backward movements with respect to another recording-head.

Moreover, the recording of the image by the image-recording apparatus 1 according to the seventh embodiment in the one-path reciprocating print mode will be described. However, the image-recording apparatus 1 of the seventh embodiment can also record the image in the one-path reciprocating print mode. In this case, the solenoid driving mechanism 16 described in the second embodiment is disposed in the carriage 20. Moreover, after each recording-head 30 ends the printing in one direction, the phase deviates from that of the speed fluctuation of the carriage during the previous printing in one direction, before the next printing of one direction. In this manner, the position of the carriage 20 on the endless belt 12 is moved. Additionally, the position is preferably moved by the distance of $\pi r$.

Additionally, needless to say, the image-recording apparatus 1 of the seventh embodiment can also be configured so that all the recording-heads 30 can eject only the single color ink.

(Eighth Embodiment)

Figure 11:
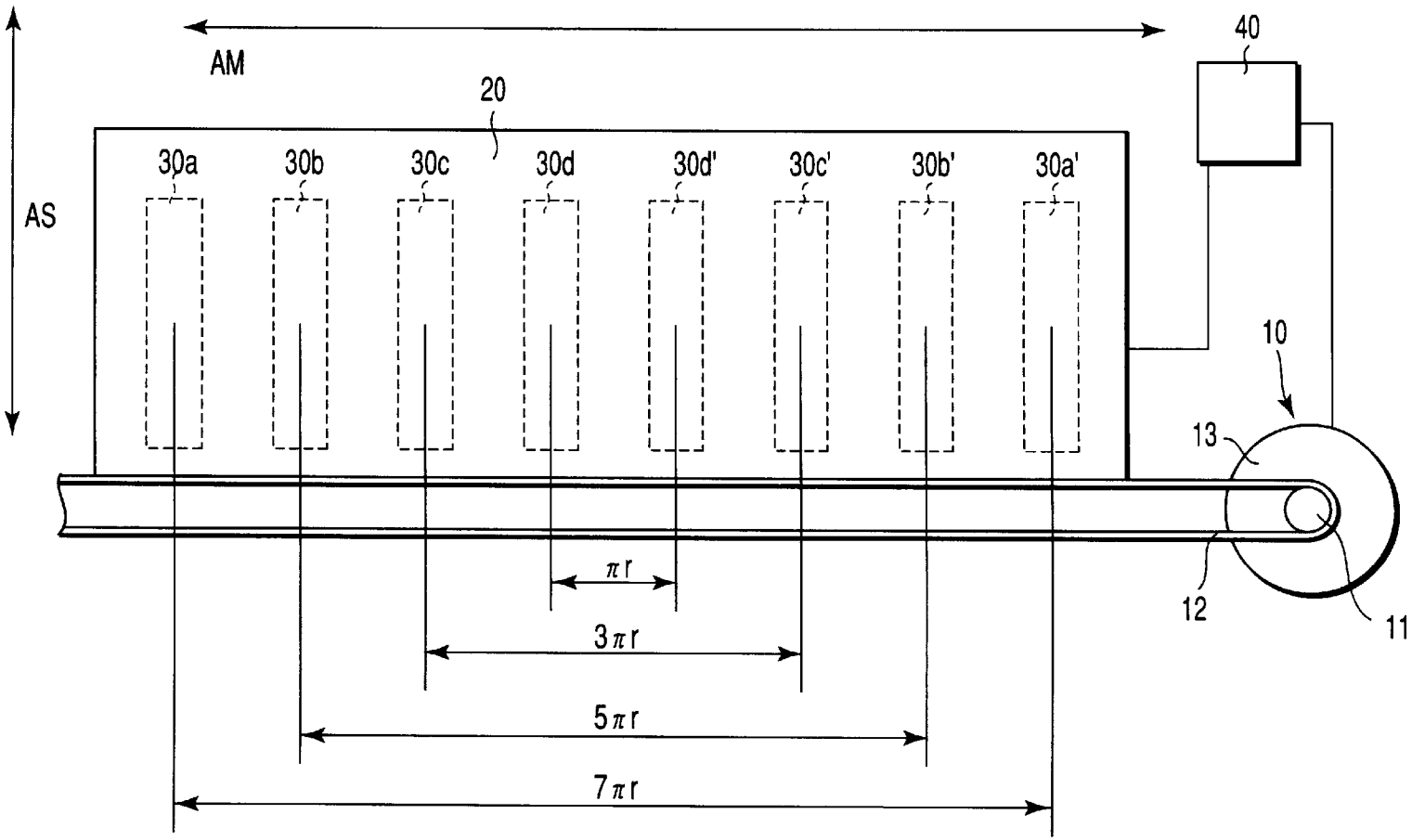
FIG. 11 is a schematic side view showing the recording-head 30 according to an eighth embodiment.
Figure 13:
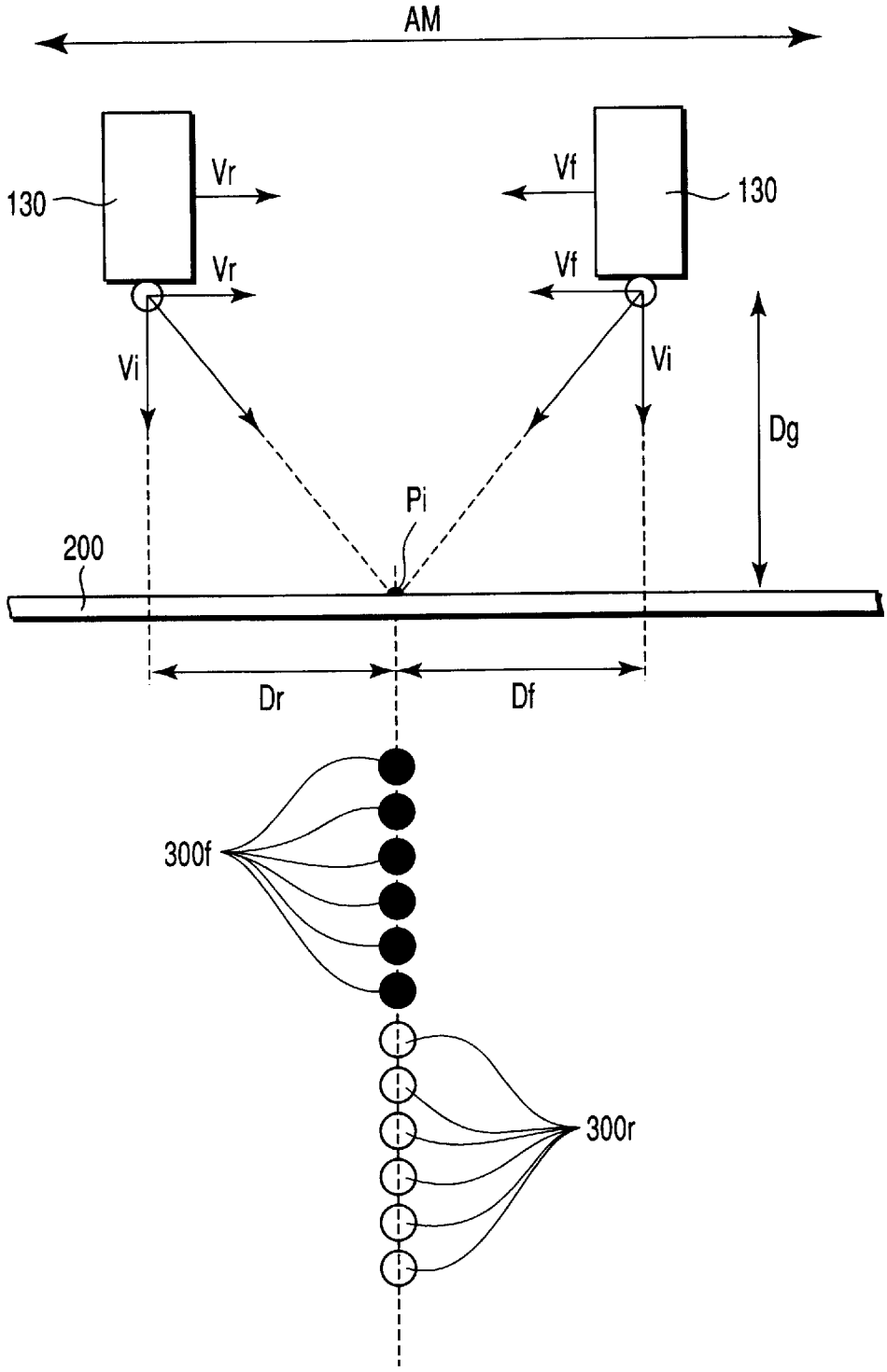
FIG. 13 PRIOR ART
FIG. 13 is a diagram showing shot positions of ink drops ejected from a recording-head of the image-recording apparatus including pulleys and motor which have no eccentricity.

The image-recording apparatus 1 of an eighth embodiment will be described hereinafter. The image-recording apparatus 1 according to the eighth embodiment is different from that of the seventh embodiment in that a plurality of recording-heads 30 are arranged symmetrically with respect to an optional center on the carriage 20 along the main scanning direction. Additionally, in the eighth embodiment, the center is positioned in the middle of the main scanning direction of the carriage 20. In the arrangement of the above-described recording-heads 30, concretely as shown in FIG. 11, the recording-heads 30*c* and 30*c′* are arranged symmetrically from the center via the recording-heads 30*d*, 30*d′*. Moreover, the recording-heads 30*b* and 30*b′* are arranged symmetrically via the recording-heads 30*c*, 30*c′*. Furthermore, the recording-heads 30*a* and 30*a′* are arranged symmetrically via the recording-heads 30*b*, 30*b′*. Additionally, an interval between the recording-heads 30*d*, 30*d′* is $\pi r$, and an interval between the recording-heads 30*c*, 30*c′* is $3\pi r$. An interval between the recording-heads 30*b*, 30*b′* is $5\pi r$, and an interval between the recording-heads 30*a*, 30*a′* is $7\pi r$.

Moreover, the image-recording apparatus 1 of the eighth embodiment is used for the color printing. The recording-heads 30*a*, 30*a* are constituted to eject the black ink, the recording-heads 30*b*, 30*b′* are to eject the cyan ink, the recording-heads 30*c*, 30*c′* are to eject the magenta ink, and the recording-heads 30*d*, 30*d′* are to eject the yellow ink.

The action of the image-recording apparatus 1 according to the eighth embodiment will be described hereinafter. Particularly the one-path reciprocating print mode of the image-recording apparatus 1 will be described.

In the image-recording apparatus 1, during the forward movement, the recording-heads 30*a*, 30*b*, 30*c*, 30*d* on the moving-direction side in the backward movement from the center are used. During the backward movement, the recording-heads 30*a′*, 30*b′*, 30*c′*, 30*d′* are used. That is, the order of the ejected ink colors is the same in the forward and backward movements.

In the image-recording apparatus, the recording-head 30*a* for use during the forward movement is disposed on the carriage 20 so as to deviate from the recording-head 30*a′* for use during the backward movement by a distance of $7\pi r$. That is, the distance is odd-number times the movement distance $\pi r$ of the carriage 20 corresponding to ½ of the speed fluctuation period of each recording-head. Therefore, the speed fluctuation of the recording-head 30*a* during the forward movement deviates from the speed fluctuation of the recording-head 30*a′* during the backward movement by $\pi$ radian. Therefore, the black ink-dot-line recorded by the recording-head 30*a* and the black ink-dot-line recorded by the recording-head 30*a′* are recorded in the same position in the main scanning direction.

Moreover, for the other recording-heads, similarly as described above, the recording-heads 30*b* and 30*b′*, 30*c* and 30*c′*, 30*d* and 30*d′* also deviate from each other by odd-number times the movement distance $\pi r$ of the carriage 20 corresponding to ½ of the speed fluctuation period of each recording-head. Therefore, the recorded ink-dot-lines of the same color are recorded in the same position in the main scanning direction. Therefore, in the image-recording apparatus 1, even when the speed of the recording-head 30 fluctuates by the eccentricity of the pulley 11 and motor 13, the density unevenness is reduced or prevented from being generated in the recorded image, and the high-precision image can be recorded.

Additionally, in the eighth embodiment, as described above, the order of the colors of inks ejected from a plurality of recording-heads 30 is the same in the forward and backward movements. Therefore, since the order of color superimposition is the same in the forward and backward movements, the ink-dot-line colors disposed adjacent to each other along the sub scanning direction are substantially the same in the respective shot positions along the main scanning direction. The generation of color unevenness can be reduced as compared with the case in which the order of color superimposition is uneven.

Moreover, in the eighth embodiment, the interval between the recording-heads of the same color along the main scanning direction is not limited, as long as the phases of the speed fluctuations of the carriages in the forward and backward movements can deviate from each other by $\pi$ radian. In other words, the interval between the recording-heads of the same color is not limited, as long as the interval is odd-number times the movement distance of or of the carriage 20 moved in the ½ period of the speed fluctuation of the carriage.

Furthermore, in the eighth embodiment, two recording-heads 30 are disposed to dispose each color of ink. However, the recording-heads 30, 30' disposed in the most vicinity of the center are close to each other as compared with the distance between the other recording-heads. Therefore, to eject colors not so conspicuous for human eyes (e.g., light colors such as yellow), it is disposed to combine the heads into one. In this case, for the image-recording apparatus 1, since the recording-head can be omitted, manufacturing cost can be suppressed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. An image-recording apparatus conveying a recording-medium and recording an image on the recording-medium, the apparatus including a main scanning direction which crosses to the conveying direction of the recording-medium, the image-recording apparatus comprising:

a recording-head discharging ink to the recording-medium;

a carriage on which the recording-head is mounted and the carriage which is reciprocatable along the main scanning direction; and a carriage drive mechanism reciprocating the carriage along the main scanning direction, wherein the carriage drive mechanism includes:

a pair of pulleys, a motor supplying a driving force to at least one of the pair of pulleys; and an endless belt which is extended between the pair of pulleys and on which the carriage is mounted, and the carriage drive mechanism reciprocates the carriage so that a phase of a periodic speed fluctuation of the carriage during a forward movement of the carriage deviates from a phase of a periodic speed fluctuation of the carriage during a backward movement of the carriage.

2. The image-recording apparatus according to claim 1, wherein the carriage drive mechanism drives the carriage, so that the phase of the speed fluctuation of the carriage during the forward movement of the carriage deviates from the phase of the speed fluctuation during the backward movement of the carriage by odd-number times $\pi$ radian.

3. The image-recording apparatus according to claim 2, further comprising an image-recording area to record the image, the image-recording area extending along the main scanning direction, wherein the carriage drive mechanism drives the carriage, so that at an optional position in the image-recording area, a sum of a carriage speed in passing the position during the forward movement and a carriage speed in passing the position during the backward movement is a sum of the carriage speed of initially set during the forward and backward movements.

4. The image-recording apparatus according to claim 1, wherein the carriage drive mechanism further includes:

a carriage support portion to movably support the carriage so that the carriage relatively be shifted along the main scanning direction with respect to the endless belt; and a carriage shift mechanism which shifts the carriage on the carriage support portion, wherein the carriage shift mechanism relatively shifts the carriage with respect to the carriage support portion by a predetermined shift amount, so that a position of carriage in the backward movement is different from position of carriage in the forward movement, and the shift amount is set to a distance other than a distance in which the carriage moves in a time corresponding to integer times one period of the speed fluctuation of the carriage.

5. The image-recording apparatus according to claim 4, wherein the shift amount is a distance in which the carriage moves in a time corresponding to odd-number times ½ of the speed fluctuation period of the carriage.

6. The image-recording apparatus according to claim 4, wherein the carriage support has a first carriage position, and a second carriage position different from the first carriage position, and the carriage shift mechanism positions the carriage in the first carriage position during the forward movement, and positions the carriage in the second carriage position during the backward movement.

7. The image-recording apparatus according to claim 6, further comprising an image-recording area to record the image and a carriage reverse area except for the image-recording area, the image-recording area and the carriage reverse area extending along the main scanning direction, wherein the carriage shift mechanism shifts the carriage, when the carriage is positioned in the carriage reverse area.

8. The image-recording apparatus according to claim 7, wherein the carriage shift mechanism has a motor control circuit which controls rotation of the motor.

9. The image-recording apparatus according to claim 7, wherein the carriage drive mechanism has a solenoid disposed on the carriage support portion.

10. The image-recording apparatus according to claim 1, further comprising an image-recording area to record the image and a carriage reverse area except for the image-recording area, the image-recording area and the carriage reverse area extending along the main scanning direction, wherein the carriage drive mechanism further includes:

a clutch which is disposed between the motor and the pulley, and which selectively transmits the driving force of the motor to the pulley;

a clutch control circuit to turn off the clutch, when the carriage is positioned in the reverse area; and a sensor to detect a difference of a relative rotation amount of the motor and pulley after the clutch is turned off, and the clutch control circuit turns on the clutch, when the sensor detects generation of the difference of the rotation amount.

11. The image-recording apparatus according to claim 10, wherein the difference of the rotation amount detected by the sensor is odd-number times ½ rotation.

12. The image-recording apparatus according to claim 1, further comprising an image-recording area to record the image and a carriage reverse area except for the image-recording area, the image-recording area and the carriage reverse area extending along the main scanning direction, wherein the carriage drive mechanism further includes:

a clutch which is disposed between the motor and the pulley, and which selectively transmits the driving force of the motor to the pulley;

a clutch control circuit to turn off the clutch, when the carriage stops in the reverse area; and a motor rotation sensor to detect a rotation amount of the motor rotated after the clutch is turned off, and the clutch control circuit turns on the clutch, when the motor rotation sensor detects a predetermined rotation amount of the motor.

13. The image-recording apparatus according to claim 12, wherein the predetermined rotation amount is ½ rotation.

14. The image-recording apparatus according to claim 1, further comprising an image-recording area to record the image and a carriage reverse area except for the image-recording area, the image-recording area and the carriage reverse area extending along the main scanning direction, wherein the carriage drive mechanism further includes:

a clutch which is disposed between the motor and the pulley, and which selectively transmits the driving force of the motor to the pulley;

a clutch control circuit to turn off the clutch, when the carriage is positioned in the reverse area outside the image-recording area;

a motor rotation sensor to detect a rotation amount of the motor rotated after the clutch is turned off;

a carriage position sensor to detect a movement amount of the carriage moved after the clutch is turned off; and an operation circuit which calculates a movement distance of the carriage based on the rotation amount of the motor, and compares the calculated movement distance of the carriage with the movement amount of the carriage detected by the carriage position sensor, and the clutch control circuit turns on the clutch, when a predetermined difference is generated between the movement distance and the movement amount.

15. The image-recording apparatus according to claim 14, wherein the difference of the predetermined movement distance is odd-number times a distance in which the carriage moves during ½ period of the speed fluctuation of the carriage.

16. The image-recording apparatus according to claim 1, further comprising an image-recording area to record the image and a carriage reverse area except for the image-recording area, the image-recording area and the carriage reverse area extending along the main scanning direction, wherein the carriage drive mechanism further includes:

a clutch which is disposed between the motor and the pulley, and which selectively transmits the driving force of the motor to the pulley;

a clutch control circuit to turn off the clutch, when the carriage is positioned in the reverse area;

a timer to measure a time elapsed after the clutch is turned off; and a memory to store a time in which a difference of the rotation amounts of the pulley and motor reaches a predetermined rotation amount after turning off the clutch, and the clutch control circuit turns on the clutch, when the time measured by the timer reaches the time set in the memory.

17. The image-recording apparatus according to claim 16, wherein the predetermined rotation amount is odd-number times ½ rotation.

18. An image-recording apparatus conveying a recording-medium and recording an image on the recording-medium, and the apparatus including a main scanning direction which crosses to the conveying direction of the recording-medium, the image-recording apparatus comprising:

the recording-head which ejects ink to the recording-medium;

a carriage on which the recording-head is mounted and the carriage which is reciprocatable along the main scanning direction; and a carriage drive mechanism which reciprocates the carriage along the main scanning direction, wherein the carriage drive mechanism includes:

a pair of pulleys; a motor which supplies a driving force to at least one of the pair of pulleys; and an endless belt which is extended between the pair of pulleys and on which the carriage is mounted, and the carriage drive mechanism reciprocates the carriage and impart a phase difference of $(1/X)2\pi$ radian in periodic speed fluctuation between any reciprocation and the immediately following reciprocation, where X is a number of path through which the carriage is reciprocated in a multi-pass printing mode.

19. An image-recording apparatus conveying a recording-medium and recording an image on the recording-medium, comprising:

a plurality of recording-heads which are arranged along a conveying direction of the recording-medium, each of the a recording-head discharging ink to the recording-medium;

a carriage on which the plurality of recording-heads are mounted and which can reciprocate along a main scanning direction crossing to a conveying direction of the recording-medium; and a carriage drive mechanism which moves the carriage along the main scanning direction, wherein the plurality of recording-heads are arranged so that an interval from the adjacent recording-head in the main scanning direction is a distance other than a distance integer times a distance in which carriage moves during one period of a speed fluctuation of the carriage.

20. The image-recording apparatus according to claim 19, wherein the recoding heads ejects different color of ink, respectively.

21. The image-recording apparatus according to claim 20, wherein the recoding heads are arranged so that an interval between the recoding heads disposed adjacent to each other is a distance odd-number times a distance in which the carriage moves during ½ period of the speed fluctuation of the carriage along the main scanning direction.

22. An image-recording apparatus conveying a recording-medium and recording an image on the recording-medium, the apparatus including a main scanning direction which crosses to the conveying direction of the recording-medium, the image-recording apparatus comprising:

two recording-heads which eject the same color of ink;

a carriage which holds the two recording-heads arranged along the main scanning direction and which is reciprocatable along the main scanning direction; and a carriage drive mechanism which moves the carriage along the main scanning direction, wherein the two recording-heads are arranged on the carriage so that an arrangement interval between the recording-heads is a distance odd-number times a distance in the carriage moves during ½ period of periodic speed fluctuation of the carriage, one of the two recording-heads is used to record the image, when the carriage is moved forwards, and the other recording-head is used to record the image, when the carriage is moved backwards.

* * * * *